US012612826B2

(12) United States Patent
Sheikhrezaei et al.

(10) Patent No.: US 12,612,826 B2
(45) Date of Patent: Apr. 28, 2026

(54) DRILL BIT CUTTER ELEMENTS WITH MULTIPLE SURFACE FINISHES

(71) Applicant: NATIONAL OILWELL VARCO, L.P., Houston, TX (US)

(72) Inventors: Kian Sheikhrezaei, Spring, TX (US); Bradley S. Blaylock, Montgomery, TX (US); Prabhakaran Centala, Spring, TX (US); Tom S. Roberts, Montgomery, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 18/853,292

(22) PCT Filed: Mar. 27, 2023

(86) PCT No.: PCT/US2023/016434
§ 371 (c)(1),
(2) Date: Oct. 1, 2024

(87) PCT Pub. No.: WO2023/200584
PCT Pub. Date: Oct. 19, 2023

(65) Prior Publication Data

US 2025/0223872 A1 Jul. 10, 2025

Related U.S. Application Data

(60) Provisional application No. 63/330,579, filed on Apr. 13, 2022.

(51) Int. Cl.
*E21B 10/567* (2006.01)
*E21B 10/42* (2006.01)

(52) U.S. Cl.
CPC ..... *E21B 10/5676* (2013.01); *E21B 10/42* (2013.01); *E21B 10/5673* (2013.01)

(58) Field of Classification Search
None
See application file for complete search history.

(56) References Cited

U.S. PATENT DOCUMENTS 5,447,208 A 9/1995 Lund et al.
6,161,990 A * 12/2000 Oles ..... B24B 1/00 407/119

(Continued)

FOREIGN PATENT DOCUMENTS

WO 2010/132235 A2 11/2010

OTHER PUBLICATIONS

PCT/US2023/016434 International Search Report and Written Opinion dated Jun. 16, 2023 (14 p.).

(Continued)

*Primary Examiner* — Blake Michener
(74) *Attorney, Agent, or Firm* — CONLEY ROSE, P.C.

(57) ABSTRACT

A cutter element for a fixed cutter drill bit has a central axis and includes a cylindrical substrate and a cutting layer mounted to the substrate. The cutting layer includes a first end engaged with the substrate, a second end opposite the first end, and a radially outer surface extending axially between the first and second ends. In addition, the cutting layer includes a cutting surface positioned at the second end and a cutting tip positioned between the cutting surface and the radially outer surface. Further, the cutting layer includes a first region on the cutting surface having a first surface roughness, and a second region on the cutting surface having a second surface roughness that is higher than the first surface roughness. The second region covers the central axis along the cutting surface, and the first region extends from the second region to the cutting tip.

18 Claims, 17 Drawing Sheets

(56) References Cited

U.S. PATENT DOCUMENTS

| | | | | |
|---|---|---|---|---|
| 8,991,525 | B2 | 3/2015 | Bilen et al. | |
| 2010/0288564 | A1 | 11/2010 | Dovalina, Jr. et al. | |
| 2011/0259642 | A1 | 10/2011 | DiGiovanni et al. | |
| 2013/0292188 | A1 | 11/2013 | Bilen et al. | |
| 2014/0246253 | A1* | 9/2014 | Patel | B24D 99/005 51/307 |
| 2016/0130881 | A1* | 5/2016 | Alsup | E21B 10/567 175/430 |
| 2018/0320450 | A1 | 11/2018 | Borge | |
| 2022/0251905 | A1* | 8/2022 | Duffy | E21B 10/5735 |
| 2023/0203892 | A1* | 6/2023 | Webb | E21B 10/42 175/428 |

OTHER PUBLICATIONS

PCT/US2023/016434 Informal Comments to the Written Opinion of the International Searching Authority Dated Jun. 16, 2023; Filed Aug. 8, 2023 (3 p.).

Extended European Search Report dated Mar. 3, 2026, for European Application No. 23788743.5 (9 p.).

* cited by examiner

DRILL BIT CUTTER ELEMENTS WITH MULTIPLE SURFACE FINISHES

CROSS-REFERENCE TO RELATED APPLICATIONS

This application is a 35 U.S.C. § 371 U.S. National Phase entry of and claims priority to PCT/US2023/016434 filed Mar. 27, 2023, and entitled "Drill Bit Cutter Elements with Multiple Surface Finishes," which claims benefit of U.S. provisional application Ser. No. 63/330,579 filed Apr. 13, 2022, and entitled "Drill Bit Cutter Elements with Multiple Surface Finishes," each of which is hereby incorporated herein by reference in its entirety for all purposes.

STATEMENT REGARDING FEDERALLY SPONSORED RESEARCH OR DEVELOPMENT

Not applicable.

BACKGROUND

The present disclosure relates generally to earth-boring bits used to drill a borehole for the ultimate recovery of oil, gas, minerals, or other resources. More particularly, the disclosure relates to fixed cutter drill bits with improved cutter elements.

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created has a diameter generally equal to the diameter or "gage" of the drill bit.

Fixed cutter bits, also known as rotary drag bits, are one type of drill bit commonly used to drill boreholes. Fixed cutter bit designs include a plurality of blades angularly spaced about a bit face. The blades generally project radially outward along the bit face and form flow channels therebetween. Cutter elements are typically grouped and mounted on the blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PD") material. In the typical fixed cutter bit, each cutter element includes an elongate and generally cylindrical support member that is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate), as well as mixtures or combinations of these materials. The cutting layer is mounted to one end of the corresponding support member, which is typically formed of tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the passageways between the several blades. The drilling fluid exiting the face of the bit through nozzles or ports performs several functions. In particular, the fluid removes formation cuttings (for example, rock chips) from the cutting structure of the drill bit. Otherwise, accumulation of formation cuttings on the cutting structure may reduce or prevent the penetration of the drill bit into the formation. In addition, the fluid removes formation cuttings from the bottom of the hole. Failure to remove formation materials from the bottom of the hole may result in subsequent passes by cutting structure to essentially re-cut the same materials, thereby reducing the effective cutting rate and potentially increasing wear on the cutting surfaces of the cutter elements. The drilling fluid flushes the cuttings removed from the bit face and from the bottom of the hole radially outward and then up the annulus between the drill string and the borehole sidewall to the surface. Still further, the drilling fluid removes heat, caused by contact with the formation, from the cutter elements to prolong cutter element life.

BRIEF SUMMARY

Some embodiments disclosed herein are directed to a cutter element for a fixed cutter drill bit that is configured to drill a borehole in a subterranean formation. In an embodiment, the cutter element has a central axis and includes a cylindrical substrate and a cutting layer mounted to the substrate. The cutting layer includes a first end engaged with the substrate, a second end opposite the first end along the central axis, and a radially outer surface extending axially between the first end and the second end. In addition, the cutting layer includes a cutting surface positioned at the second end and a cutting tip positioned between the cutting surface and the radially outer surface. Further, the cutting layer includes a first region on the cutting surface having a first surface roughness and a second region on the cutting surface having a second surface roughness that is higher than the first surface roughness. The second region covers the central axis along the cutting surface, and the first region extends from the second region to the cutting tip.

Some embodiments disclosed herein are directed to a fixed cutter drill bit configured to drill a borehole in a subterranean formation. In an embodiment, the drill bit includes a bit body having a bit face, a blade extending from the bit face, and a cutter element mounted to a cutter-supporting surface on the blade. The cutter element has a central axis and includes a substrate and a cutting layer mounted to the substrate. The cutting layer includes a first end engaged with the substrate, a second end opposite the first end along the central axis, and a radially outer surface extending axially between the first end and the second end. In addition, the cutting layer includes a cutting surface positioned at the second end and a cutting tip positioned between the cutting surface and the radially outer surface. Further, the cutting layer includes a first region on the cutting surface having a first surface roughness and a second region on the cutting surface having a second surface roughness that is higher than the first surface roughness. The second region is spaced radially from the cutting tip at a distance D via the first region. In addition, the cutter element is mounted to the cutter-supporting surface at a backrake angle ε measured between the central axis and the cutter-supporting surface. Further, the cutter element has an extension height H measured perpendicularly from the cutter-supporting surface to the cutting tip, and wherein the extension height H is less than a projection of the distance D about the backrake angle E.

Some embodiments disclosed herein are directed to a cutter element for a fixed cutter drill bit configured to drill a borehole in a subterranean formation. In an embodiment, the cutter element has a central axis and includes a substrate and a cutting layer mounted to the substrate. The cutting layer includes a first end engaged with the substrate, a second end opposite the first end along the central axis, and a radially outer surface extending axially between the first end and the second end. In addition, the cutting layer includes a cutting surface positioned at the second end and a cutting tip positioned between the cutting surface and the radially outer surface. Further, the cutting layer includes a first region on the cutting surface having a first surface area and a first surface roughness and a second region on the cutting surface having a second surface area and a second surface roughness. The first region annularly surrounds the second region. In addition, the second surface roughness is higher than the first surface roughness. Further, the first surface area and the second surface area constitute an entire surface area of the cutting surface.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

The cost of drilling a borehole for recovery of hydrocarbons may be very high and is proportional to the length of time it takes to drill to the desired depth and location. The time required to drill the well, in turn, is greatly affected by the rate of penetration ("ROP") of the drill bit into the formation and the operational life of the drill bit. For instance, each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. This process, known as a "trip" of the drill string, requires considerable time, effort and expense. Accordingly, it is desirable to employ drill bits which will drill faster and longer.

The length of time that a drill bit may be employed before it must be changed depends upon a variety of factors. These factors include the bit's ROP, as well as its durability or ability to maintain a high or acceptable ROP. One factor that significantly affects ROP and durability for a drill bit is the cutting efficiency of the cutter elements of the drill bit during drilling. The cutting efficiency of a cutter element refers to a measure or ratio of the volume of rock removed for a given driving force applied to the cutter element. Accordingly, embodiments of drill bits described herein and the associated cutter elements offer the potential to improve cutting efficiency during drilling.

Figure 1:
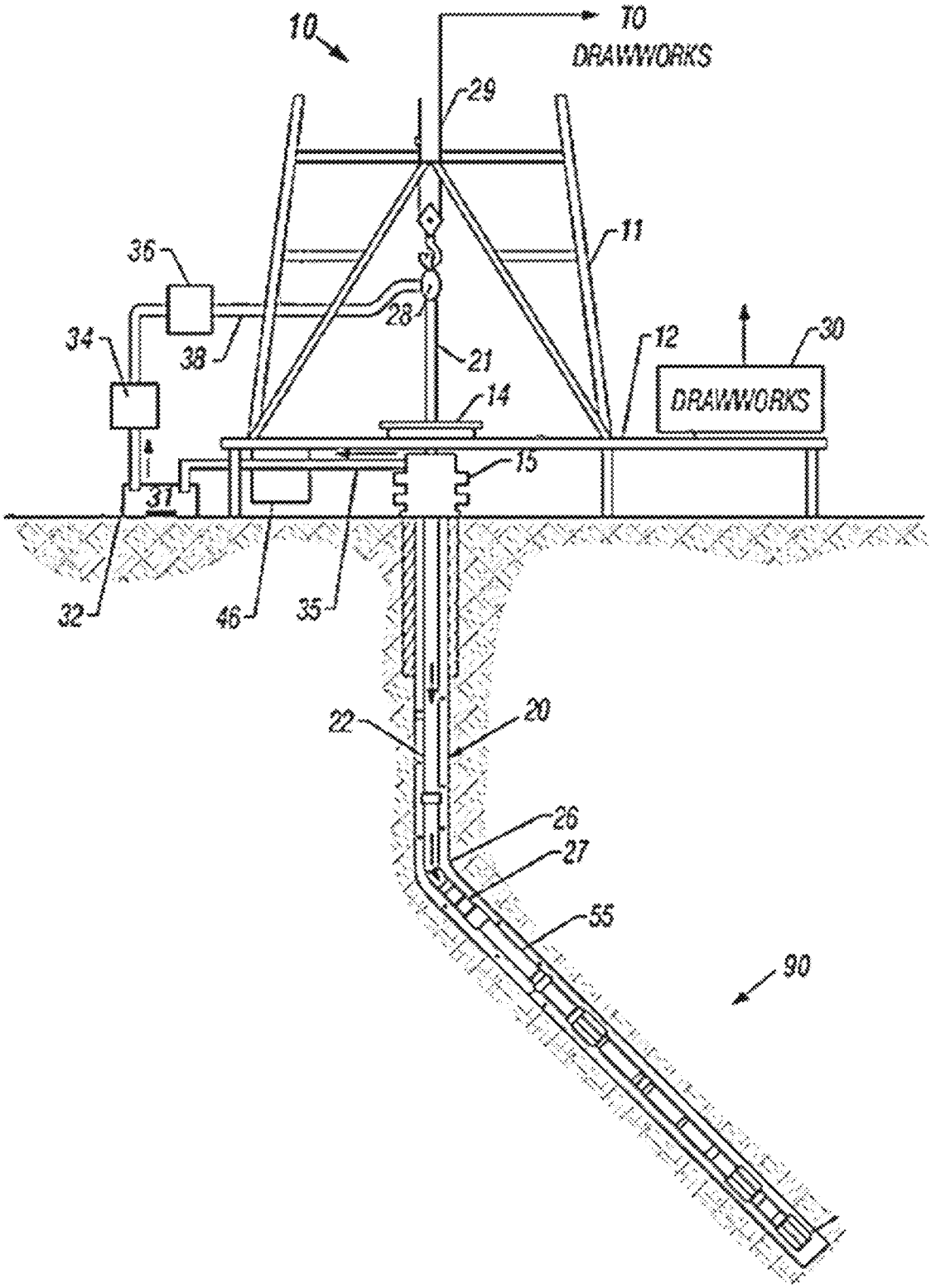
FIG. 1 is a schematic view of a drilling system including an embodiment of a drill bit in accordance with the principles described herein.

Referring now to FIG. 1, a schematic view of a drilling system 10 according to some embodiments is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). In other embodiments, the rotary table (for example, rotary table 14) may be augmented or replaced by a top drive suspended in the derrick (for example, derrick 11) and connected to the drillstring (for example, drillstring 20).

Drilling assembly 90 includes a drillstring 20 and a drill bit 100 coupled to the lower end of drillstring 20. Drillstring 20 is made of a plurality of pipe joints 22 connected end-to-end, and extends downward from the rotary table 14 through a pressure control device 15, such as a blowout preventer (BOP), into the borehole 26. The pressure control device 15 is commonly hydraulically powered and may contain sensors for detecting certain operating parameters and controlling the actuation of the pressure control device 15. Drill bit 100 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 100 through the formation. In this embodiment, drill bit 100 can be rotated from the surface by drillstring 20 via rotary table 14 or a top drive, rotated by downhole mud motor 55 disposed along drillstring 20 proximal bit 100, or combinations thereof (for example, rotated by both rotary table 14 via drillstring 20 and mud motor 55, rotated by a top drive and the mud motor 55, etc.). For example, rotation via downhole motor 55 may be employed to supplement the rotational power of rotary table 14, if required, or to effect changes in the drilling process. In either case, the ROP of the drill bit 100 into the borehole 26 for a given formation and a drilling assembly largely depends upon the WOB and the rotational speed of bit 100.

During drilling operations a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 100, circulates to the surface through an annular space 27 radially positioned between drillstring 20 and the sidewall of borehole 26, and then returns to mud tank 32 via a solids control system 46 and a return line 35. Solids control system 46 may include any suitable solids control equipment known in the art including, without limitation, shale shakers, centrifuges, and automated chemical additive systems. Solids control system 46 may include sensors and automated controls for monitoring and controlling, respectively, various operating parameters such as centrifuge rpm. It should be appreciated that much of the surface equipment for handling the drilling fluid is application specific and may vary on a case-by-case basis.

Figure 2:
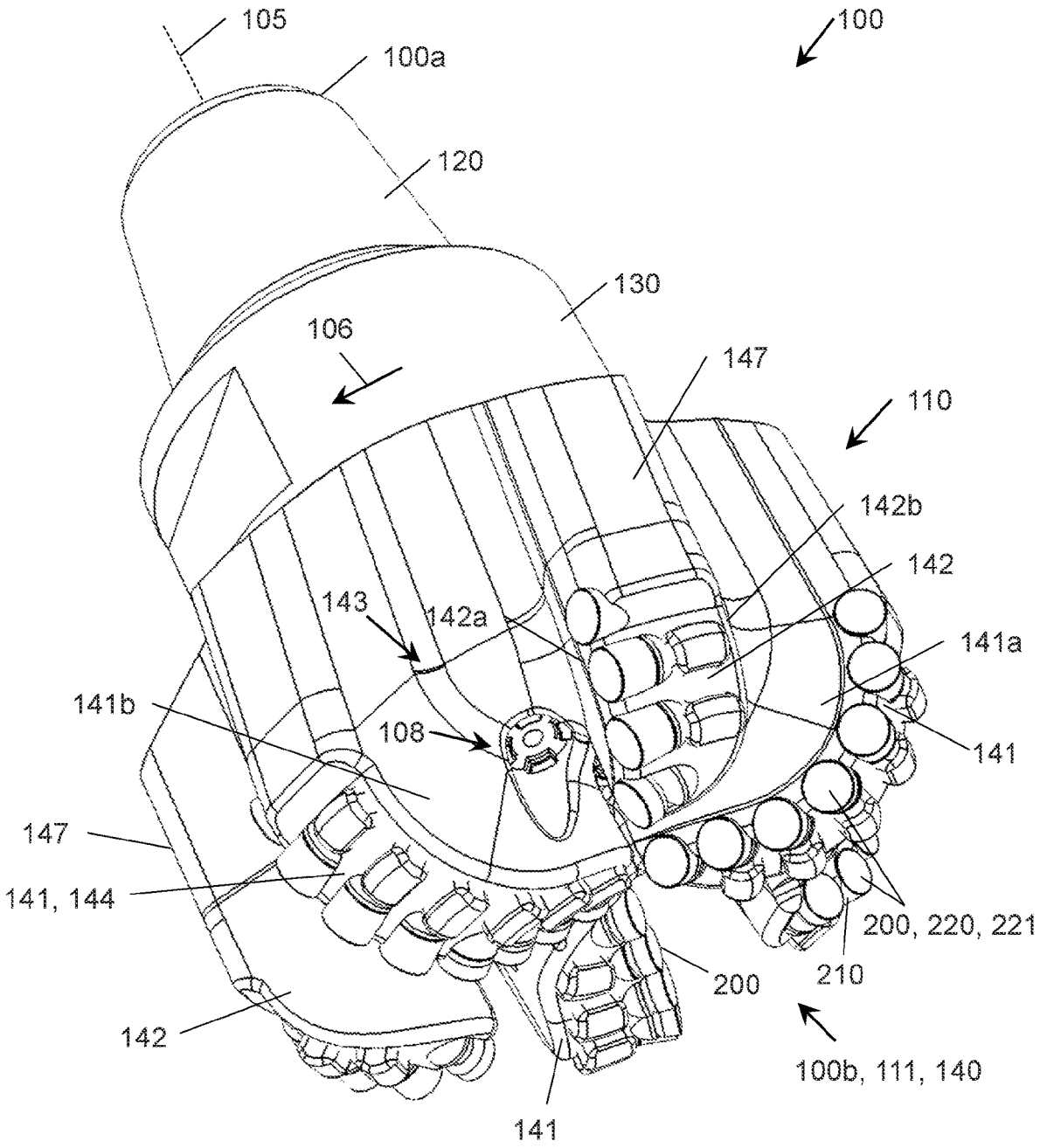
FIG. 2 is a perspective view of the drill bit of FIG. 1.
Figure 3:
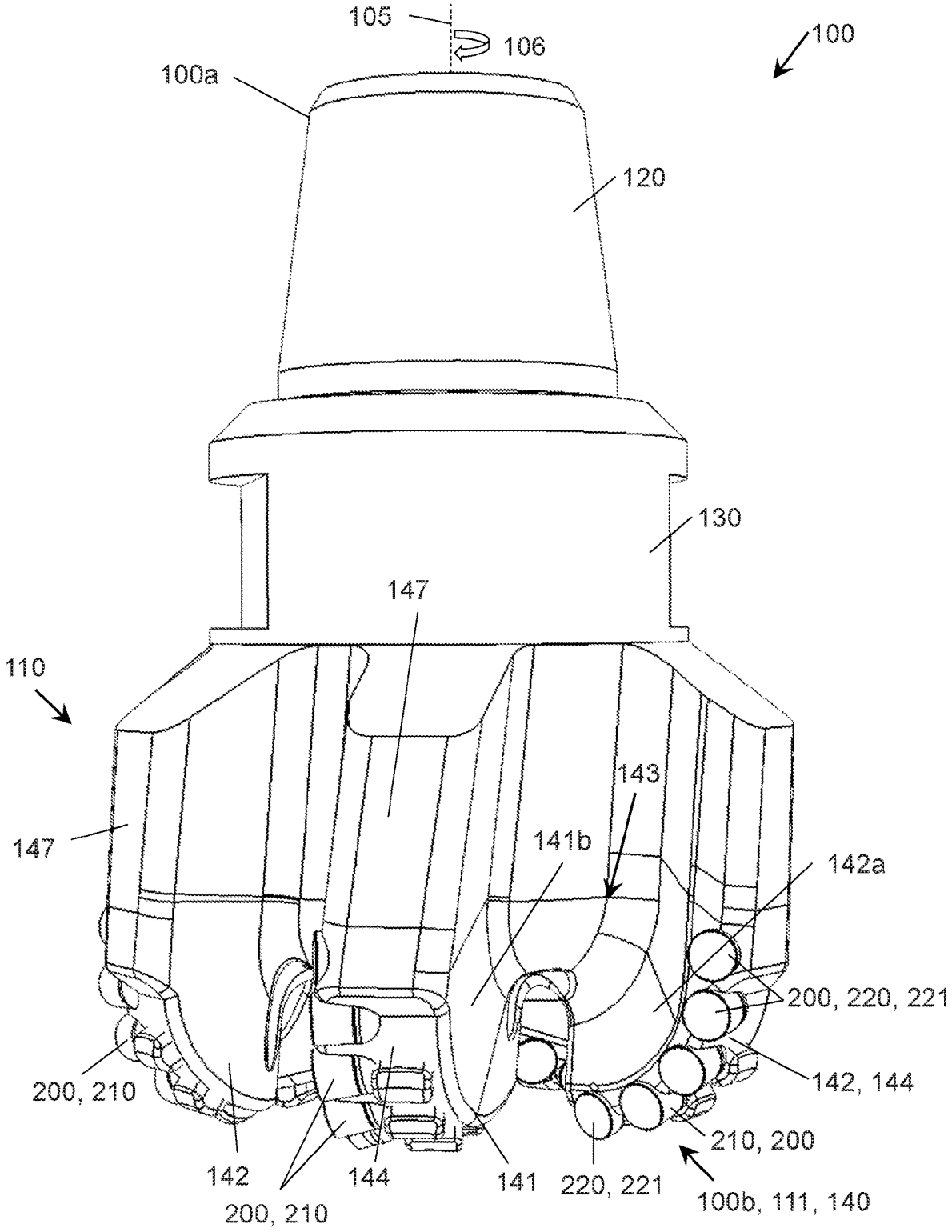
FIG. 3 is a side view of the drill bit of FIG. 2.
Figure 4:
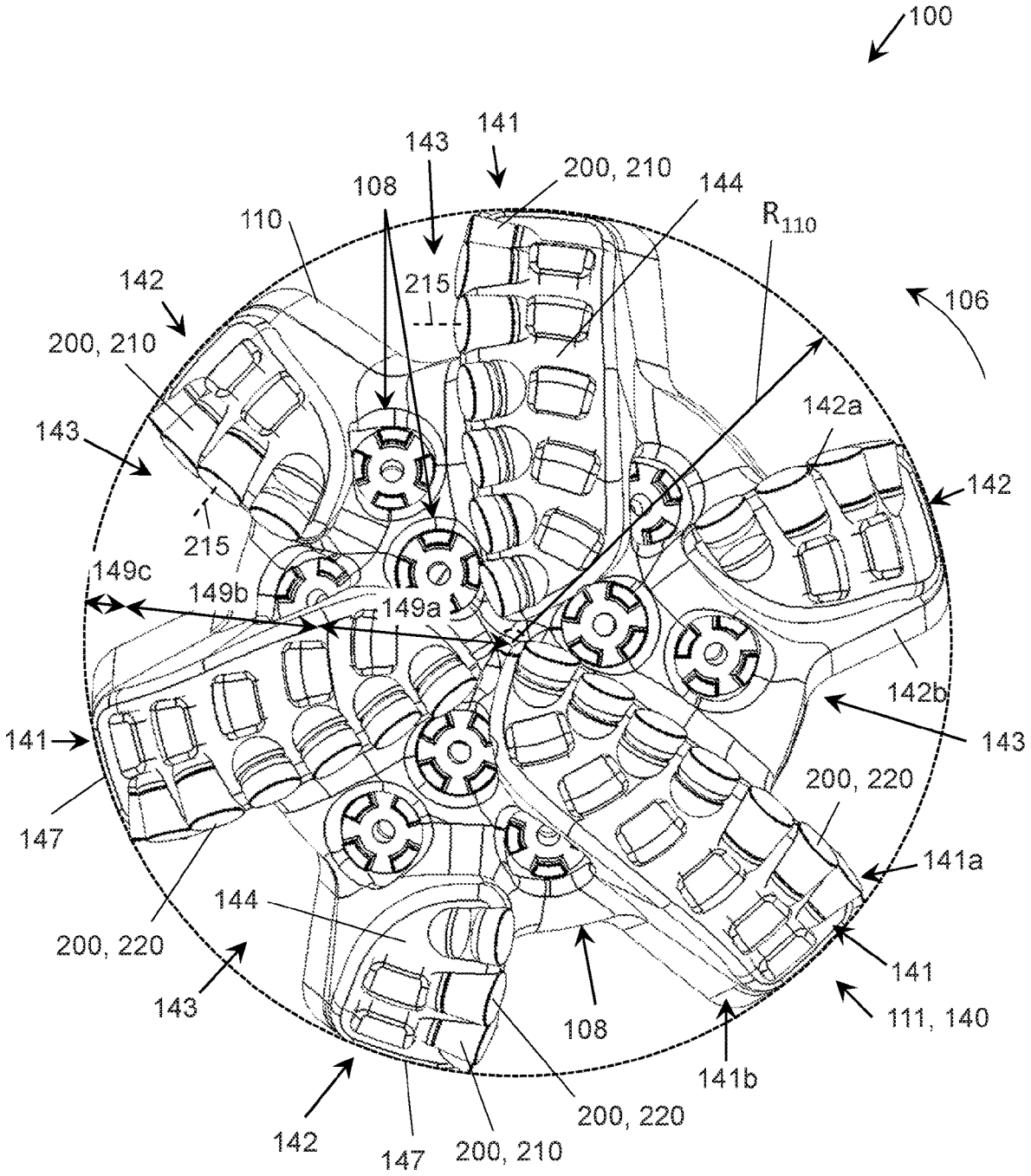
FIG. 4 is an end view of the drill bit of FIG. 2.

Referring now to FIGS. 2-4, drill bit 100 is a fixed cutter bit, sometimes referred to as a drag bit, and is designed for drilling through formations of rock to form a borehole. Bit 100 has a central or longitudinal axis 105, a first or uphole end 100*a*, and a second or downhole end 100*b*. Bit 100 rotates about axis 105 in the cutting direction represented by direction 106. In addition, bit 100 includes a bit body 110 extending axially from downhole end 100*b*, a threaded connection or pin 120 extending axially from uphole end 100*a*, and a shank 130 extending axially between pin 120 and body 110. Pin 120 couples bit 100 to drillstring 20 (FIG. 1), which is employed to rotate the bit 100 in order to drill the borehole as previously described. Bit body 110, shank 130, and pin 120 are coaxially aligned with axis 105, and thus, each has a central axis coincident with axis 105.

The portion of bit body 110 that faces the formation at downhole end 100*b* includes a bit face 111 provided with a cutting structure 140. Cutting structure 140 includes a plurality of blades that extend from bit face 111. As best shown in FIG. 4, in this embodiment, cutting structure 140 includes three angularly spaced-apart primary blades 141 and three angularly spaced apart secondary blades 142. Further, in this embodiment, the plurality of blades (for example, primary blades 141, and secondary blades 142) are uniformly angularly spaced on bit face 111 about bit axis 105. In particular, the three primary blades 141 are uniformly angularly spaced about 120° apart, the three secondary blades 142 are uniformly angularly spaced about 120° apart, and each primary blade 141 is angularly spaced about 60° from each circumferentially adjacent secondary blade 142. In other embodiments, one or more of the blades may be spaced non-uniformly about bit face 111. Still further, in this embodiment, the primary blades 141 and secondary blades 142 are circumferentially arranged in an alternating fashion. In other words, one secondary blade 142 is disposed between each pair of circumferentially-adjacent primary blades 141. Although bit 100 is shown as having three primary blades 141 and three secondary blades 142, in general, bit 100 may comprise any suitable number of primary and secondary blades. As one example only, bit 100 may comprise two primary blades and four secondary blades.

Referring again to FIGS. 2-4, in this embodiment, primary blades 141 and secondary blades 142 are integrally formed as part of, and extend from, bit body 110 and bit face 111. Primary blades 141 and secondary blades 142 extend generally radially along bit face 111 and then axially along a portion of the periphery of bit 100. In particular, primary blades 141 extend radially from proximal central axis 105 toward the periphery of bit body 110. Primary blades 141 and secondary blades 142 are separated by drilling fluid flow courses 143. Each blade 141, 142 has a leading edge or side 141*a*, 142*a*, respectively, and a trailing edge or side 141*b*, 142*b*, respectively, relative to the rotation direction 106 of bit 100.

Referring still to FIGS. 2-4, each blade 141, 142 includes a cutter-supporting surface 144 that generally faces the formation during drilling and extends circumferentially from the leading side 141*a* to the trailing side 141*b* of the corresponding blade 141, 142. In this embodiment, a plurality of cutter elements 200 are fixably mounted to cutter supporting surface 144 of each blade 141, 142. Cutter elements 200 are generally arranged adjacent one another in a radially extending row proximal the leading side 141*a* of each primary blade 141 and each secondary blade 142. However, in other embodiments, the cutter elements (for example, cutter elements 200) may be arranged differently or arranged with cutter elements having different geometries.

As will be described in more detail below, each cutter element 200 includes an elongated and generally cylindrical support base or substrate 210 and a cylindrical disk or tablet-shaped, hard cutting layer 220 of polycrystalline diamond or other superabrasive material bonded to the exposed end of substrate 210. Substrate 210 has a central axis 215, and is received and secured in a pocket formed in cutter supporting surface 144 of the corresponding blade 141, 142 to which it is fixably mounted. The cylindrical disc, hard cutting layer 220 defines a cutting surface or cutting face 221 of the corresponding cutter element 200. As will be described in more detail below, in some embodiments, each cutting face 221 may be the same or different. In addition, in some embodiments, the cutting face 221 of some or all of the cutter elements 200 may or may not be completely planar. For instance, in some embodiments, the cutting face 221 of some of all of the cutter elements 200 may comprise a single planar surface, so that the cutting layer 220 generally comprises a right-circular cylinder in shape. In some embodiments, the cutting face 221 of some or all of the cutter elements may comprise a plurality of distinct, spaced planar surfaces that intersect a plurality of distinct, spaced cutting edges along the cutting face 221. In some embodiments, the cutting face 221 or some or all of the cutter elements may include a non-planar surface. As used herein, the phrase "non-planar" may be used to refer to a cutting face that includes one or more curved surfaces (for example, concave surface(s), convex surface(s), or combinations thereof), a plurality of distinct planar surfaces that intersect at distinct edges along the cutting face, or both.

In the embodiments described herein, each cutter element 200 is mounted such that the corresponding central axis 215 is substantially parallel to or at an acute angle relative to the cutting direction of the bit (for example, cutting direction 106 of bit 100). Such orientation results in the corresponding cutting face 221 being generally forward-facing relative to the cutting direction of the bit (for example, cutting direction 106 of bit 100).

Referring still to FIGS. 2-4, bit body 110 further includes gage pads 147 of substantially equal axial length measured generally parallel to bit axis 105. Gage pads 147 are circumferentially-spaced about the radially outer surface of bit body 110. Specifically, one gage pad 147 intersects and extends from each blade 141, 142. In this embodiment, gage pads 147 are integrally formed as part of the bit body 110. In general, gage pads 147 can help maintain the size of the borehole by a rubbing action when cutter elements 200 wear slightly under gage. Gage pads 147 also help stabilize bit 100 against vibration.

Figure 5:
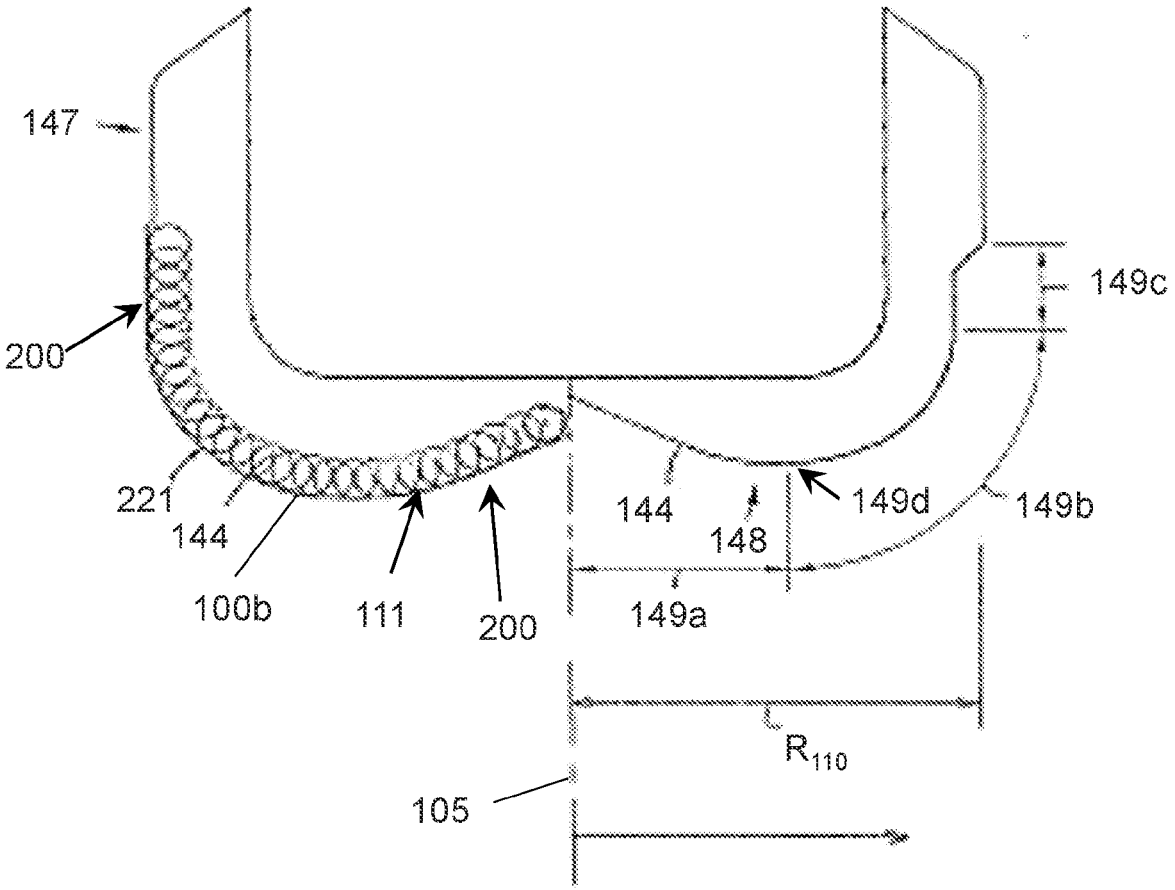
FIG. 5 is a partial cross-sectional schematic view of the bit shown in FIG. 2 with the blades and the cutting faces of the cutter elements rotated into a single composite profile.

Referring now to FIG. 5, an exemplary profile of blades 141, 142 is shown as it would appear with blades 141, 142 and cutting faces 221 rotated into a single rotated profile. In rotated profile view, blades 141, 142 form a combined or composite blade profile 148 generally defined by cutter-supporting surfaces 144 of blades 141, 142. In this embodiment, the profiles of surfaces 144 of blades 141, 142 are generally coincident with each other, thereby forming a single composite blade profile 148.

Composite blade profile 148 and bit face 111 may generally be divided into three regions conventionally labeled cone region 149*a*, shoulder region 149*b*, and gage region 149*c*. Cone region 149*a* is the radially innermost region of bit body 110 and composite blade profile 148 that extends from bit axis 105 to shoulder region 149*b*. In this embodiment, cone region 149*a* is generally concave. Adjacent cone region 149*a* is generally convex shoulder region 149*b*. The transition between cone region 149*a* and shoulder region 149*b*, referred herein to as the nose 149*d*, occurs at the axially outermost portion of composite blade profile 148 (relative to bit axis 105) where a tangent line to the blade profile 148 has a slope of zero. Moving radially outward, adjacent shoulder region 149*b* is the gage region 149*c*, which extends substantially parallel to bit axis 105 at the outer radial periphery of composite blade profile 148. As shown in composite blade profile 148, gage pads 147 define the gage region 149*c* and the outer radius Rio of bit body 110. Outer radius $R_{110}$ extends to and therefore defines the full gage diameter of bit 100.

Referring briefly to FIG. 4, moving radially outward from bit axis 105, bit 100 and bit face 111 include cone region 149*a*, shoulder region 149*b*, and gage region 149*c* as previously described. Primary blades 141 extend radially along bit face 111 from within cone region 149*a* proximal bit axis 105 toward gage region 149*c* and outer radius $R_{110}$. Secondary blades 142 extend radially along bit face 111 from proximal nose 149*d* toward gage region 149*c* and outer radius Rio. Thus, in this embodiment, each primary blade 141 and each secondary blade 142 extends substantially to gage region 149*c* and outer radius $R_{110}$. In some embodiments (e.g., such as in the embodiment of FIG. 4), secondary blades 142 do not extend into cone region 149*a*, and thus, secondary blades 142 occupy no space on bit face 111 within cone region 149*a*. Although a specific embodiment of bit body 110 has been shown in described, one skilled in the art will appreciate that numerous variations in the size, orientation, and locations of the blades (for example, primary blades 141, secondary blades, 142, etc.), and cutter elements (for example, cutter elements 200) are possible.

Bit 100 includes an internal plenum (not shown) extending axially from uphole end 100*a* through pin 120 and shank 130 into bit body 110. The plenum allows drilling fluid to flow from the drill string into bit 100. Body 110 is also provided with a plurality of flow passages (not shown) extending from the plenum to downhole end 100*b*. As best shown in FIGS. 2-4, a nozzle 108 is seated in the lower end of each flow passage. Together, the plenum (not shown), passages (not shown), and nozzles 108 serve to distribute drilling fluid around cutting structure 140 to flush away formation cuttings and to remove heat from cutting structure 140, and more particularly cutter elements 200, during drilling.

Referring again to FIGS. 2-4, on each blade 141, 142, cutter elements 200 are arranged side-by-side in a row along the corresponding cutter supporting surface 144. Thus, in this embodiment, cutter elements 200 are positioned radially adjacent one another on a given blade 141, 142. However, in other embodiments, the cutter elements (for example, cutter elements 200) may be arranged in rows with one or more cutter element having different geometries on the same blade (for example, blade 141, 142).

Figure 6A:
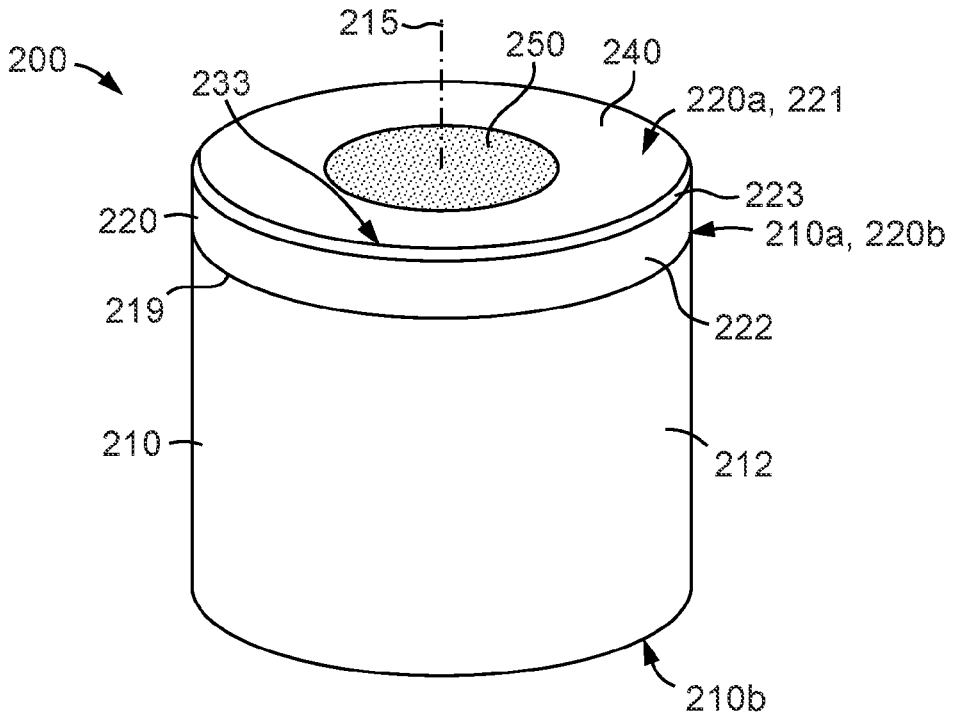
FIGS. 6A and 6B are perspective and top views, respectively, of one of the cutter elements of the drill bit of FIG. 1 according to some embodiments.
Figure 6B:
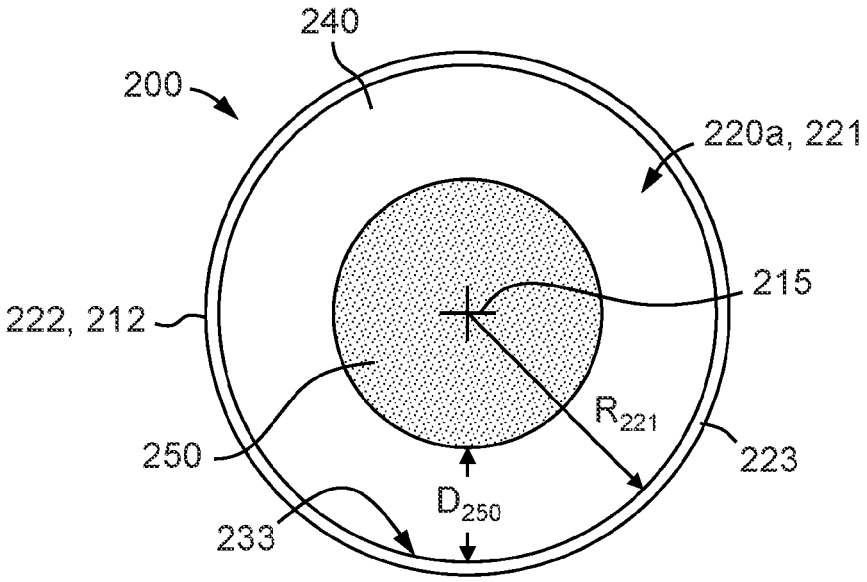

Referring now to FIGS. 6A and 6B, one cutter element 200 is shown. Although only one cutter element 200 is shown in FIGS. 6A and 6B, it is to be understood that all cutter elements 200 of bit 100 may be the same. In general, bit 100 may include any number of cutter elements 200, and further, cutter elements 200 can be used in connection with different cutter elements (for example, cutter elements having geometries different than cutter element 200) on the same bit (for example, bit 100).

As previously described, cutter element 200 includes base or substrate 210 and cutting disc or layer 220 bonded to the substrate 210. Cutting layer 220 and substrate 210 meet at a reference plane of intersection 219 that defines the location at which substrate 210 and cutting layer 220 are fixably attached. In this embodiment, substrate 210 is made of tungsten carbide and cutting layer 220 is made of an ultrahard material such as polycrystalline diamond (PCD) or other superabrasive material. Part or all of the diamond in cutting layer 220 may be leached, finished, polished, or otherwise treated to enhance durability, efficiency or effectiveness. While cutting layer 220 is shown as a single layer of material mounted to substrate 210, in general, the cutting layer (for example, layer 220) may be formed of one or more layers of one or more materials. In addition, although substrate 210 is shown as a single, homogenous material, in general, the substrate (for example, substrate 210) may be formed of one or more layers of one or more materials.

Substrate 210 has central axis 215 as previously described and which generally defines the central axis of cutter element 200. In addition, substrate 210 has a first end 210*a* bonded to cutting layer 220 at plane of intersection 219, a second end 210*b* opposite end 210*a* and distal cutting layer 220, and a radially outer surface 212 extending axially between ends 210*a*, 210*b*. In this embodiment, substrate 210 is generally cylindrical, and thus, outer surface 212 is a cylindrical surface.

Referring still to FIGS. 6A and 6B, cutting layer 220 has a first end 220*a* distal substrate 210, a second end 220*b* bonded to end 210*a* of substrate 210 at plane of intersection 219, and a radially outer surface 222 extending axially between ends 220*a*, 220*b*. In this embodiment, cutting layer 220 is generally disc-shaped, and thus, outer surface 222 is generally cylindrical. Outer surfaces 212, 222 of substrate 210 and cutting layer 220, respectively, are coextensive and contiguous such that there is a generally smooth transition moving axially between outer surfaces 212, 222.

The outer surface of cutting layer 220 at first end 220*a* defines cutting face 221 of cutter element 200, which is designed and shaped to engage and shear the formation during drilling operations. In this embodiment, a chamfer or bevel 223 is provided at the intersection of cutting face 221 and radially outer surface 222. In some embodiments, bevel 223 may comprise a frustoconical surface positioned between the cutting face 221 and radially outer surface 222. In some embodiments, bevel 223 may comprise an arcuate surface positioned between cutting face 221 and radially outer surface 222.

In this embodiment, cutter element 200 and cutting face 221 are symmetric about central axis 215, such that cutting layer 220 is shaped as a right-circular cylinder. Thus, the cutting face 221 is generally circular in shape and is completely planar so that the cutting face 221 is positioned within and along a plane that is oriented perpendicular to the central axis 215. In addition, cutting face 221 and bevel 223 define cutting surfaces designed to engage and shear the formation during drilling operations. For instance, cutting face 221 intersects bevel 223 along a radially outer, circumferentially extending cutting edge. As will be described in more detail below, cutter element 200 is positioned and oriented on the drill bit 100 such that the portion of the edge at the intersection between cutting face 221 and bevel 223 engages the formation during drilling, and thus, defines a cutting tip or edge 233 of cutting face 221. The cutting face 221 may have a radius $R_{221}$ extending radially outward from axis 215 to cutting tip 233.

The cutting face 221 includes one or more first regions 240 and one or more second regions 250. Generally speaking, the one or more first regions 240 may be smoother than the one or more second regions 250, and conversely the one or more second regions 250 may be rougher than the one or more first regions 240. Thus, the one or more second regions 250 may have a higher coefficient of friction (or "friction coefficient") than the one or more first regions 240 when sliding another object across the cutting face 221. It follows that an object or material (e.g., such as a cutting from a subterranean formation as described in more detail below) may encounter higher sliding resistance within the second region(s) 250 than the first region(s) 240.

In some embodiments, the one or more first regions 240 has a first surface roughness $R_{240}$ and the one or more second regions 250 has a second surface roughness $R_{250}$. The first surface roughness $R_{240}$ and the second surface roughness $R_{250}$ may each refer to an average amplitude of a surface profile (about some reference plane or line) along the corresponding surface 240, 250, respectively. In some embodiments, the first surface roughness $R_{240}$ may range from about 0.0025 micro meters (μm) to about 0.075 μm and the second surface roughness $R_{250}$ may range from about 0.25 μm to about 10 μm. Thus, the second surface roughness $R_{250}$ may be about 3 to about 4000 times greater the first surface roughness $R_{240}$ in some embodiments. For instance, in some embodiments, the second surface roughness $R_{250}$ may be about 5 to about 32 times greater than the first surface roughness $R_{240}$.

In some embodiments, the one or more first regions 240 and the one or more second regions 250 are formed by polishing and/or lapping the entire cutting face 221 to achieve the final surface roughness of the first region(s) 240 (e.g., roughness $R_{240}$ previously described). Thereafter, the one or more second regions 250 are formed by roughening the selected portion(s) of cutting face 221 to achieve the final surface roughness of the second region(s) 250 (e.g., $R_{250}$ previously described). In some embodiments, the one or more second regions 250 are roughened using laser ablation, chemical etching, and/or any suitable mechanical or chemical technique for increasing a roughness of a surface.

In some embodiments, the one or more first regions 240 and the one or more second regions 250 may be formed by selectively lapping and/or polishing the one or more first regions 240 and not smoothing (e.g., lapping, polishing, etc.) the one more second regions 250. In some of these embodiments, the one or more second regions 250 may be roughened using any one or more of the mechanical or chemical techniques described above.

As best shown in FIG. 6B, the cutting face 221 of cutter element 200 includes one first region 240 and one second region 250. In some embodiments (e.g., such as in the embodiment of FIGS. 6A and 6B), the second region 250 is a circularly shaped region that is centered about the central axis 215, and the first region 240 is an annularly shaped region 240 that extends radially outward from the second region 250 to the cutting tip 233. Thus, the second region 250 may be said to cover the central axis 105 along the cutting face 221. In addition, the first region 240 may extend radially from the second region 250 to the cutting tip 233 such that the second region 250 may be radially spaced from the cutting tip 233 from the cutting tip 233 via the first region 240. Thus, the second region 250 may not extend to or connect to the cutting tip 233 or bevel 223, and the first region 240 may annularly surround the second region 250. In some embodiments, the radially outermost edge of the second region 250 may be spaced at a distance $D_{250}$ from the cutting tip 233. In some embodiments, the distance $D_{250}$ may range from about one-eighth (⅛) of the total radius $R_{221}$ of cutting surface 221 to the value of the radius $R_{221}$ of cutting surface 221 (e.g., $0.125*R_{221} \leq D_{250} \leq R_{221}$). In some embodiments, the distance $D_{250}$ may range from about 10% to about 50% of the total diameter of the cutting face 221, measured radially with respect to central axis 105.

The first region 240 may occupy a first surface area $SA_{240}$ along the cutting face 221, and the second region 250 may occupy a second surface area $SA_{250}$ along the cutting face 221. In some embodiments, a ratio of the second surface area $SA_{250}$ to the first surface area $SA_{240}$ (e.g., $SA_{250}/SA_{240}$) may range from about 0.25 to about 0.75. For instance, in some embodiments, the ratio of the second surface area $SA_{250}$ to the first surface area $SA_{240}$ (e.g., $SA_{250}/SA_{240}$) may equal about 0.5. Together, the first region 240 and the second region 250 may constitute the entire cutting face 221 such that the sum of the first surface area $SA_{240}$ and the second surface area $SA_{250}$ may equal the total surface area of the cutting face 221.

Referring again to FIGS. 2-4, cutting elements 200 are mounted to bit body 110 such that cutting faces 221 are exposed to the formation material, and are oriented (relative to the bit body 110) such that cutting faces 221 and cutting tip 233 are positioned to perform their functional roles in shearing, excavating, and removing rock from beneath the drill bit 100 during rotary drilling operations. More specifically, each cutter element 200 is mounted to a corresponding blade 141, 142 with substrate 210 received and secured in a pocket formed in the cutter support surface 144 of the blade 141, 142 to which it is fixed by brazing or other suitable means. In addition, each cutter element 200 is oriented such that the corresponding cutting face 221 is exposed and leads the cutter element 200 relative to cutting direction 106 of bit 100. As previously described, cutting faces 221 are forward-facing.

Figure 7:
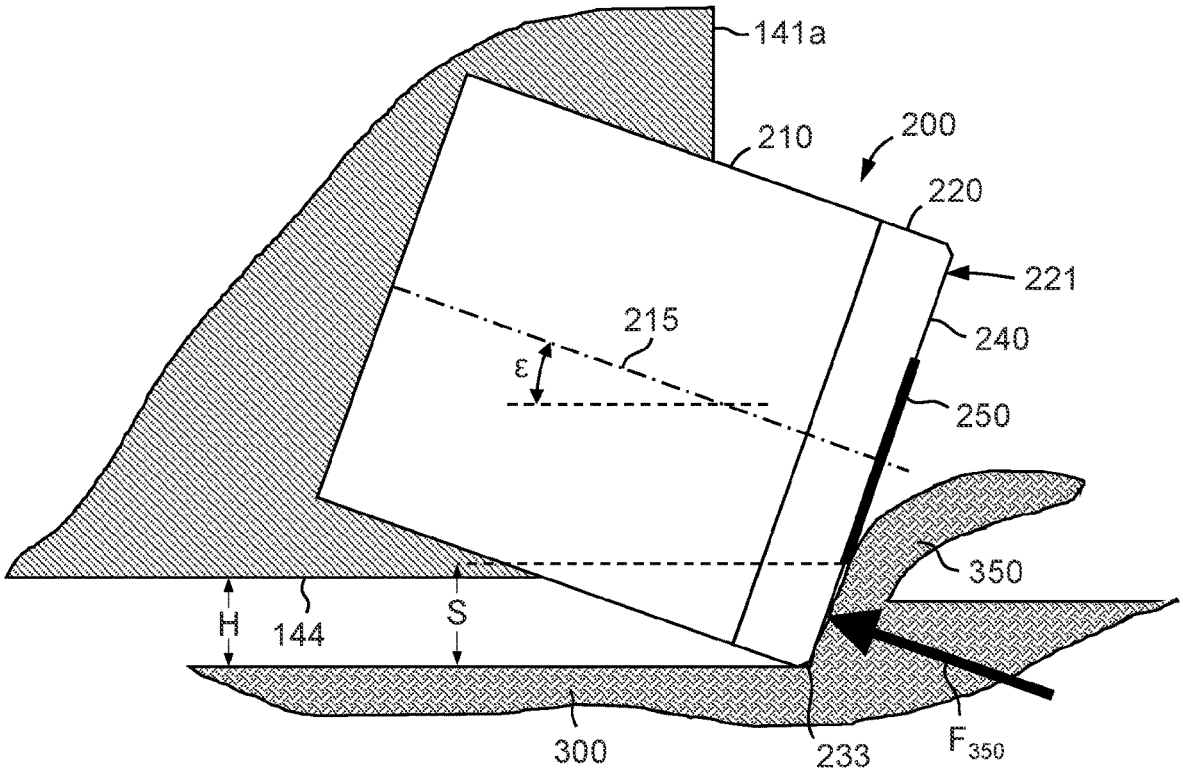
FIG. 7 is an enlarged partial cross-sectional aide view of one of the cutter elements of FIGS. 6A and 6B engaging the formation during drilling according to some embodiments.

Referring briefly to FIG. 7, a partial cross-sectional side view of one exemplary cutter elements 200 taken in a plane oriented perpendicular to cutter supporting surface 144 and parallel to axis 215 is shown. As shown in FIG. 7, each cutter element 200 is oriented with cutting tip 233 distal the corresponding cutter support surface 144 to define an extension height H of the corresponding cutter element 200. As used herein and generally known in the art, the phrase "extension height" refers to the maximum distance or height to which a structure (for example, cutting face 221) extends measured perpendicularly from the cutter-supporting surface of the blade to which it is mounted. Thus, cutting tip 233 of each cutter element 200 defines the point on the corresponding cutting face 221 that is furthest from the cutter supporting surface 144 of the corresponding blade 141, 142 as measured perpendicular to the corresponding cutter supporting surface 144. The extension heights H of cutter elements 200 are selected so as to ensure that cutting tips 233 of cutter elements 200 achieve the desired depth of cut, or at least be in contact with the rock during drilling. In embodiments described herein, the extension height H of cutter elements 200 ranges from about 1 millimeter (mm) to about 10 mm, and alternatively ranges from about 3 mm to about 8 mm. In some embodiments, the extension height H may reach up to 50% of the total diameter of the cutter element 200 (across axis 215).

Referring again to FIGS. 2-4, each cutting tip 233 also defines the radial position of the corresponding cutter element 200. As used herein, the term "radial position" of a cutter element 200 or a cutting face 221 is defined by the radial distance measured perpendicularly from the bit axis 105 to the cutting tip 233 of the cutting face that defines the extension height H (FIG. 7) of the cutter element 200. Thus, each cutter element 200 and corresponding cutting face 221 has a radial position defined by the radial distance measured perpendicularly from the bit axis 105 to the corresponding cutting tip 233. In this embodiment, each cutter element 200 on drill bit 100 has a unique radial position, and thus, each cutting tip 233 is disposed at a unique and different radial distance measured perpendicularly from the bit axis 105 to the cutting tip 233. In this embodiment, cutter elements 200 are disposed along the cone region 149*a*, at the nose 149*d*, and along the shoulder region 149*b*.

Referring again to FIG. 7, although each cutter element 200 is disposed at a different radial position relative to central axis 105 of bit 100, each cutter element 200 is mounted to the corresponding blade 141, 142 in a similar orientation relative to the corresponding cutter-supporting surface 144 and formation being drilled. Accordingly, the mounting orientation of one cutter element 200 is shown in FIG. 7 with the understanding that each cutter element 200 is mounted to the corresponding blade 141, 142 in a similar manner.

Cutter element 200 is mounted with central axis 215 oriented at an acute angle ε measured between axis 215 and cutter-supporting surface 144. It should be appreciated that during drilling operations, cutter-supporting surface 144 is parallel to the surface of the formation being cut by cutter element 200, and thus, central axis 215 is also oriented at acute angle ε relative to the surface of the formation being cut by cutter element 200. Angle ¿ may also be commonly known as a "rake angle," or more specifically, a "backrake angle" as cutter element 200 is tilted backward such that cutting face 221 generally slopes rearwardly relative to the cutting direction 106 moving radially outward along cutting face 221 toward cutting tip 233. In some embodiments described herein, each cutter element (for example, each cutter element 200) is oriented at an acute backrake angle ε ranging from 0° to 45°, and alternatively ranging from 10° to 30°.

Referring now to FIGS. 6A, 6B, and 7, during drilling operations cutting tips 233 of cutter elements 200 are engaged with the formation 300 as the bit 100 (FIGS. 2-4) is rotated (e.g., about axis 105) with WOB applied. During this process, the cutting tip 233 of each cutter element 200 is dragged across the surface of the formation 300 to shear off a cutting or chip 350 therefrom. The cutting 350 may slide along cutting face 221 from cutting tip 233, and thereby impart a resistive force $F_{350}$ on the cutting face 221 that generally opposes the advance of cutter element 200 (and the rotation of bit 100 about axis 105). The magnitude of force $F_{350}$ may be dependent (at least partially) on the contact surface area between the cutting 350 and the cutting face 221 during drilling operations.

Referring specifically to FIG. 7, as the cutting 350 slides along the cutting face 221 from the cutting tip 233 generally toward the central axis 215, the cutting 350 is initially sliding along the first region 240, and then eventually enters the second region 250. FIG. 7 schematically illustrates the second region 250 with a relatively thick or heavily weighted line so as to clearly show the location and positions of the first region 240 and the second region 250 in side view. However, it should be appreciated that the first region 240 and the second region 250 may not be visible in side view in the manner indicated in FIG. 7 in some embodiments. As previously described, the second region 250 may have a higher surface roughness ($R_{250}$) than the first region 240. Thus, as the cutting 350 slides along the first region 240 and enters the second region 250, the cutting 350 experiences an abrupt increase in sliding friction and resistance to further sliding progression across cutting face 221. As a result, a speed of the portion of cutting 350 within the second region 250 may decrease which then causes the cutting to deflect or curl away from the cutting face 221 in a direction that is generally normal (or perpendicular) to cutting face 221. Accordingly, the higher friction imparted to the cutting 350 by the second region 250 may shorten the path of cutting 350 along cutting face 221 so that the contact surface area between the cutting 350 and cutting face 221 and the associated force $F_{350}$ are reduced. Without being limited to this or any other theory, a reduction in the force $F_{350}$ on each cutter element 200 may increase a cutting efficiency of the cutter elements 200, as each cutter element 200 may experience less resistance from the formation during drilling.

In some embodiments, the distance $D_{250}$ is chosen so that, at the chosen backrake angle ε, the extension height H extends to a point on the cutting face 221 that is positioned within the first region 240 and is positioned between the second region 250 and the cutting tip 233 on each cutter element 200. Stated differently, each cutter element 200 may be attached to and arranged on bit 100 so that the extension height H and depth of cut may be less than or equal to a spacing S of the second region 250 from the cutting tip 233 (e.g., H≤S). The spacing S extends normally to the cutter-supporting surface 144 and is parallel to the extension height H, so that the spacing S may be represented as a projection of the distance $D_{250}$ about the backrake angle ε (e.g., $S=D_{250}\times\cos(\varepsilon)$). Thus, in some embodiments, the extension height H and distance $D_{250}$ may conform to the following inequality in Equation (1):

$$H \leq D_{250} \cos \varepsilon \quad (1).$$

As a result, during a drilling operation, the second region 250 on cutting face 221 may not be projected into the formation 300 so that contact between the cutting 350 and the second region 250 may result from sliding engagement of the cutting 350 radially (with respect to axis 215) along cutting face 221 during operations as previously described. Without being limited to this or any other theory, by spacing the second region 250 from the formation 300, the cutting 350 is initially formed via contact with the first region 240 and then enters the second region 250 via sliding engagement along cutting face 221. The abrupt change in surface roughness between the first region 240 and second region 250 may then promote the detachment or deflection from the cutting face 221 as previously described.

Figure 8A:
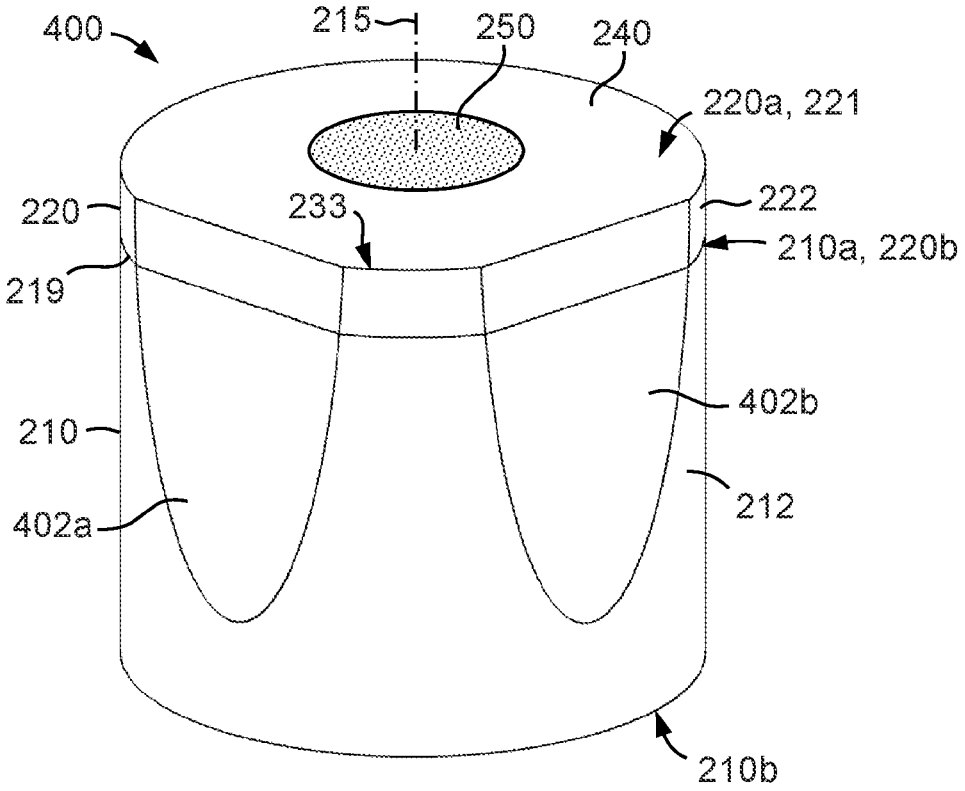
FIGS. 8A and 8B are perspective and top views, respectively, of one of the cutter elements of the drill bit of FIG. 1 according to some embodiments.
Figure 8B:
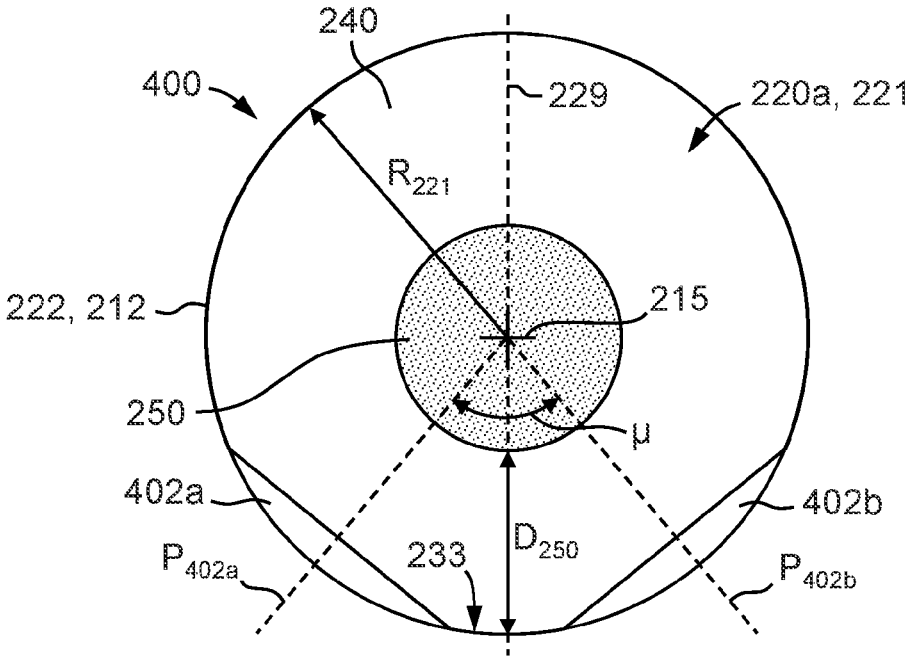

Referring now to FIGS. 8A and 8B, an embodiment of a cutter element 400 that can be used on drill bit 100 in place of one or more of the cutter elements 200 is shown. Cutter element 400 is similar to cutter element 200 previously described. Thus, features of the cutter element 400 that are the same as and shared with the cutter element 200 are identified with the same reference numerals, and thus, for purposes of conciseness, the discussion below will focus on the features of cutter element 400 that are different from the cutter element 200.

For instance, cutter element 400 is substantially the same as cutter element 200 previously described with the exception that a pair of planar flats 402*a*, 402*b* are disposed along and extend across the cylindrical radially outer surfaces 212, 222 of the substrate 210 and cutting layer 220, respectively. In addition, the cutting face 221 of cutter element 400 is generally V-shaped due to the planar flats 402*a*, 402*b* (instead of generally semi-cylindrically shaped). Each flat 402*a*, 402*b* extends axially from cutting face 221 along outer surface 222 of cutting layer 220 and across plane of intersection 219 into and along outer surface 212 of substrate 210. However, in this embodiment, flats 402*a*, 402*b* do not extend to second end 210*b* of substrate 210. Rather, flats 402*a*, 402*b* terminate at a point proximal to but axially spaced from end 210*b*. Each flat 402*a*, 402*b* is contiguous and smooth as it extends across outer surfaces 212, 222. Flats 402*a*, 402*b* are circumferentially spaced along outer surfaces 212, 222, and are positioned on opposite circumferential sides of and are symmetrical about a reference plane 229 that includes the central axis 215 and extends radially outward therefrom.

While not shown in FIGS. 8A and 8B, it should be appreciated that cutter element 400 may include a chamfer or bevel (e.g., bevel 223) at the intersection of the cutting face 221 and the outer circumferential surface 222 of cutting layer 220. In addition, the bevel may also extend between the cutting face 221 and the flats 402, 402*b* at first end 220*a* of cutting layer 220. The bevel may be similar to the bevel 223 previously described for cutter element 200 (FIGS. 6A and 68).

In this embodiment, each flat 402*a*, 402*b* is oriented perpendicular to a plane $P_{402a}$, $P_{402b}$, respectively, containing the central axis 215. Planes $P_{402a}$, $P_{402b}$ are angularly spaced apart about axis 215 by an angle μ. In some embodiments, angle μ is less than 180° alternatively ranges from 70° to 120°, and alternatively ranges from 80° to 100°.

Each flat 402*a*, 402*b* generally slopes radially outward moving axially from cutting face 221 toward second end 210*b* of substrate 210. For instance, in some embodiments, flats 402*a*, 402*b* are oriented at an acute angle (not specifically shown) measured in planes $P_{402a}$, $P_{402b}$ between central axis 215 and flats 402*a*, 402*b*. The angle between the flats 402*a*, 402*b* and central axis 215 may be 2° to 10°, 4° to 6°, or approximately 5°. In general, both flats 402*a*, 402*b* can be oriented at the same angle or different angles to the central axis 215.

Cutter element 400 is mounted to a cutter supporting surface (for example, cutter supporting surface 144) of a blade (for example, blade 141, 142) of a drill bit (for example, drill bit 100) in the same manner as cutter element 200. For example, a plurality of cutter elements 400 can be positioned and oriented at the backrake angle ε as previously described, with cutting tips defining the extension height (for example, extension height H) of the cutter elements 400, and with cutting tips designed to contact and engage the formation before cutting tip 233. In addition, the cutting face 221 includes the first region 240 and the second region 250 that were previously described above with respect to cutter element 200. The second region 250 may be circularly shaped in the manner described above for the cutter element 200. However, the first region 240 may have linear portions due to the flats 402*a*, 402*b*. As with the cutter element 200, the second region 250 may be spaced from the cutting edge (e.g., cutting tip 233) of cutting face 221 at the distance $D_{250}$ as previously described, and the distance $D_{250}$ and extension height (e.g., H in FIG. 7) of the cutter element 400 may be chosen to satisfy the inequality shown in Equation (1) above. In addition, in some embodiments the first region 240 and the second region 250 on cutter element 400 may conform to one or more of the same sizing parameters that were previously described above for the cutter element 200 (e.g., $0.25 \leq SA_{250}/SA_{240} \leq 0.75$; $SA_{240}+SA_{250}=100\%$ of cutting surface area; etc.). Thus, cutter element 400 functions in substantially the same manner as cutter element 200, and thus, offers the potential for the same benefits and advantages during drilling operations. Namely, the cutter element 400 may experience a reduced resistance (e.g., force $F_{350}$) from the formation due to selective deflection of the cuttings (e.g., cutting 350) away from the cutting face 221 via the second region 250 as previously described above. It should be appreciated that due to the presence of flats 402*a*, 402*b*, cutting face 221 has a V-shaped geometry, which presents a more aggressive profile as compared to the more semi-circular primary cutting face 221 of cutter element 200, and offers the potential for increased cutting efficiency due to a lower "shear length" (or the arc length of the cutting edge 233 that engages the formation during drilling) along the cutting edge 233. As a result, the cutting edge 233 may apply a "point loading" affect on the formation (which may shear the formation more easily).

Figure 9:
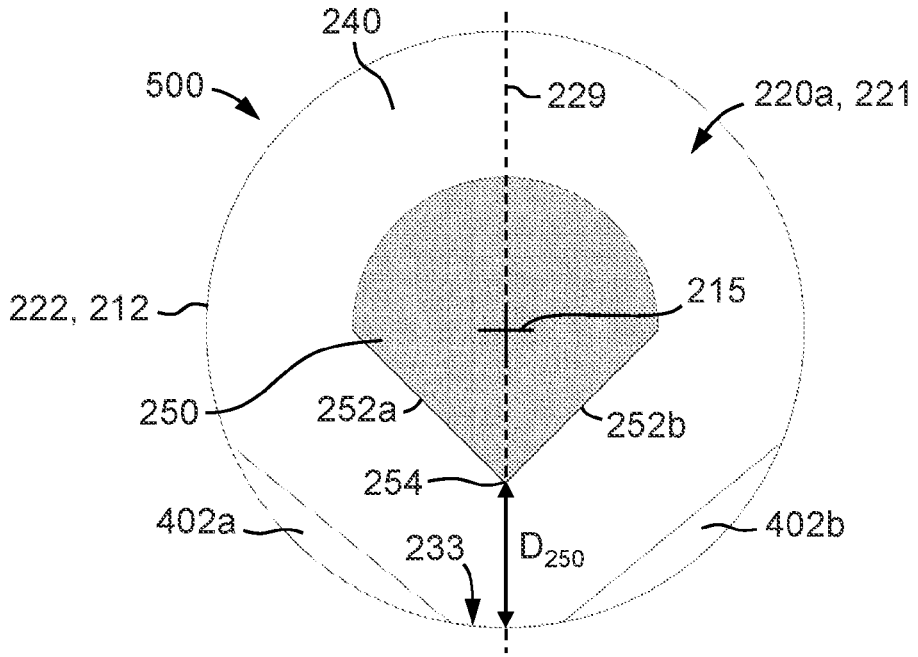
FIG. 9 is a top view of one of the cutter elements of the drill bit of FIG. 1 according to some embodiments.

Referring now to FIG. 9, an embodiment of a cutter element 500 that can be used on drill bit 100 in place of one or more of the cutter elements 200 or 400 is shown. Cutter element 500 is similar to cutter elements 200 and 400 previously described. Thus, features of the cutter element 500 that are the same as and shared with the cutter element 200 and/or cutter element 400 are identified with the same reference numerals, and thus, for purposes of conciseness, the discussion below will focus on the features of cutter element 500 that are different from the cutter elements 200 and 400.

In particular, cutter element 500 is essentially the same as cutter element 400 (FIGS. 8A and 8B), except that the second region 250 on cutting face 221 is not completely circular and instead has a pair of straight, linear edges 252*a*, 252*b* that oppose the flats 402*a*, 402*b*, respectively. The straight edges 252*a*, 252*b* may intersect at a point 254 that lies along the plane 229 extending between the flats 402*a*, 402*b*. Thus, the distance $D_{250}$ may extend from the cutting tip 233 to the point 254 along the plane 229. In addition, the straight edges 252*a*, 252*b* may be generally parallel to the flats 402*a*, 402*b*.

Cutter element 500 is mounted to a cutter supporting surface (for example, cutter supporting surface 144) of a blade (for example, blade 141, 142) of a drill bit (for example, drill bit 100) in the same manner as cutter element 200. For example, a plurality of cutter elements 500 can be positioned and oriented at the backrake angle ε as previously described, with cutting tips defining the extension height (for example, extension height H) of the cutter elements 500, and with cutting tips designed to contact and engage the formation before cutting tip 233. In addition, the distance $D_{250}$ and extension height (e.g., H in FIG. 7) of the cutter element 500 may be chosen to satisfy the inequality shown in Equation (1) above. Further, in some embodiments the first region 240 and the second region 250 on cutter element 500 may conform to one or more of the same sizing parameters that were previously described above for the cutter element 200 (e.g., $0.25 \leq SA_{250}/SA_{240} \leq 0.75$; $SA_{240}+SA_{250}=100\%$ of cutting surface area; etc.). Thus, cutter element 500 functions in substantially the same manner as cutter element 200, and thus, offers the potential for the same benefits and advantages during drilling operations. Namely, the cutter element 500 may experience a reduced resistance (e.g., force $F_{350}$) from the formation due to selective deflection of the cuttings (e.g., cutting 350) away from the cutting face 221 via the second region 250 as previously described above. The flats 252*a*, 252*b* may act to deflect the cuttings off to the side of the cutter element 500, and may induce sudden breakage of the cuttings during drilling.

Figure 10:
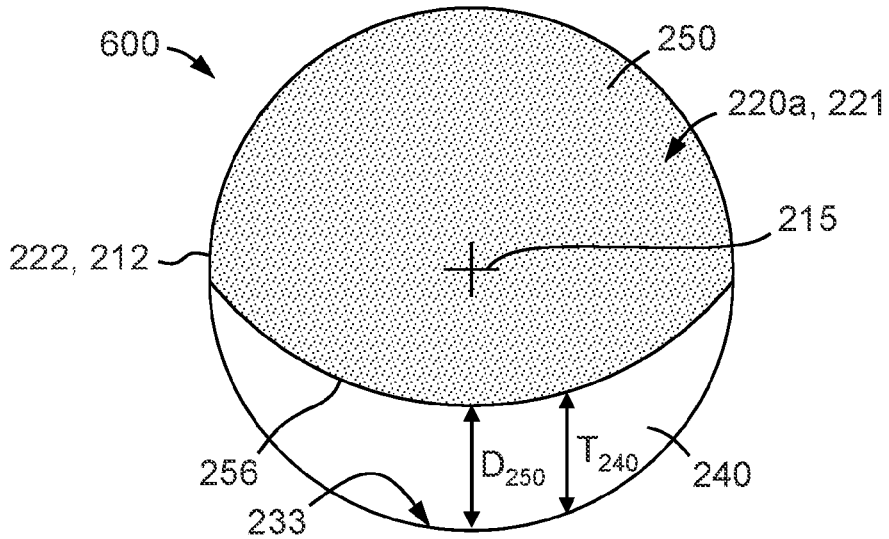
FIG. 10 is a top view of one of the cutter elements of the drill bit of FIG. 1 according to some embodiments.

Referring now to FIG. 10, an embodiment of a cutter element 600 that can be used on drill bit 100 in place of one or more cutter elements 200, 400, or 500 is shown. Cutter element 600 is similar to cutter element 200 previously described. Thus, features of the cutter element 600 that are the same as and shared with the cutter element 200 are identified with the same reference numerals, and thus, for purposes of conciseness, the discussion below will focus on the features of cutter element 600 that are different from the cutter element 200.

In particular, cutter element 600 is essentially the same as cutter element 200, except that the shapes of the first region 240 and the second region 250 are altered from that described above for cutter element 200 (FIGS. 6A and 6B). Specifically, the first region 240 comprises a crescent shaped region that extends from and along the cutting tip 233. Thus, the first region 240 includes a thickness $T_{240}$ measured radially across cutting face 221 from the cutting tip 233 to the second region 250, that tapers to points at two radially opposite ends 240*a*, 240*b* of the first region 240. The remaining portions of the cutting face 221 that are not occupied by first region 240 are covered by the second region 250. Accordingly, an arcuate (e.g., circularly curved, elliptically curved, etc.) border 256 is defined between the first region 240 and the second region 250 that extends across the cutting face 221 of cutter element 600. The border 256 may be spaced from the cutting tip 233 by the distance $D_{250}$ at the point of the cutting tip 233 that is configured to engage the formation during drilling.

Cutter element 600 is mounted to a cutter supporting surface (for example, cutter supporting surface 144) of a blade (for example, blade 141, 142) of a drill bit (for example, drill bit 100) in the same manner as cutter element 200. For example, a plurality of cutter elements 600 can be positioned and oriented at the backrake angle ε as previously described, with cutting tips defining the extension height (for example, extension height H) of the cutter elements 600, and with cutting tips designed to contact and engage the formation before cutting tip 233. In addition, the distance $D_{250}$ and extension height (e.g., H in FIG. 7) of the cutter element 600 may be chosen to satisfy the inequality shown in Equation (1) above. Further, in some embodiments the first region 240 and the second region 250 on cutter element 600 may conform to one or more of the same sizing parameters that were previously described above for the cutter element 200 (e.g., $0.25 \leq SA_{250}/SA_{240} \leq 0.75$; $SA_{240}+SA_{250}=100\%$ of cutting surface area; etc.) Thus, cutter element 600 functions in substantially the same manner as cutter element 200, and thus, offers the potential for the same benefits and advantages during drilling operations. Namely, the cutter element 600 may experience a reduced resistance (e.g., force $F_{350}$) from the formation due to selective deflection of the cuttings (e.g., cutting 350) away from the cutting face 221 via the second region 250 as previously described above.

Figure 11A:
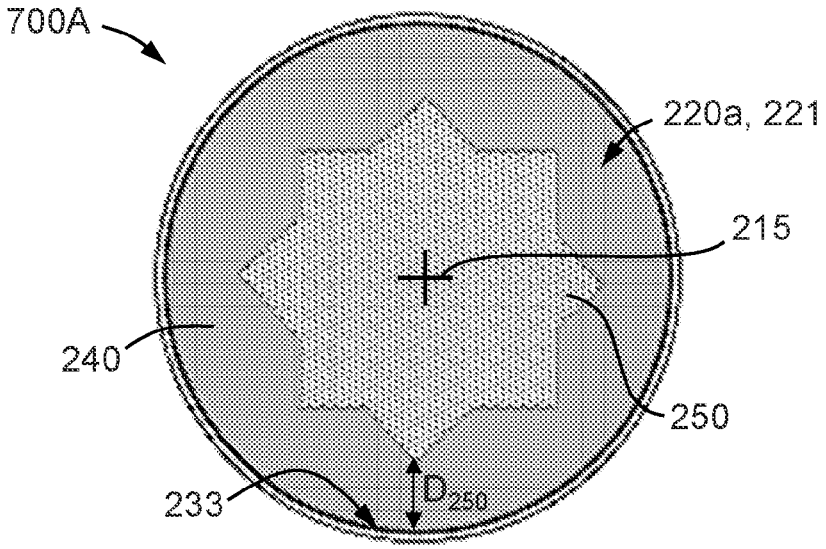
FIGS. 11A-11O are top views of cutter elements of the drill bit of FIG. 1 according to some embodiments.
Figure 11B:
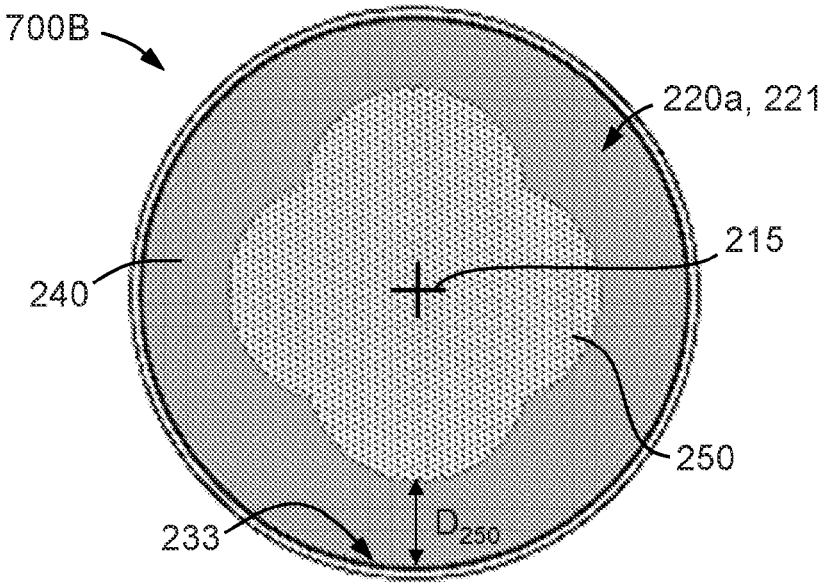
Figure 11C:
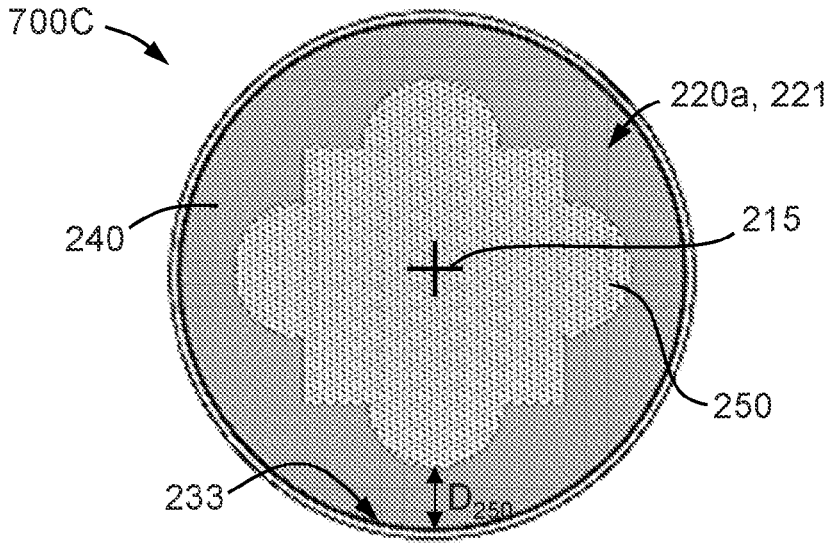
Figure 11D:
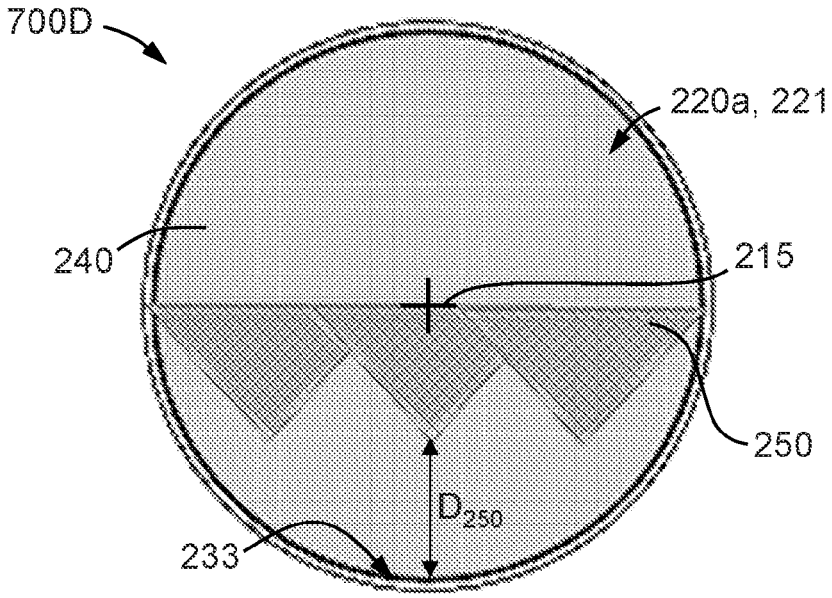
Figure 11E:
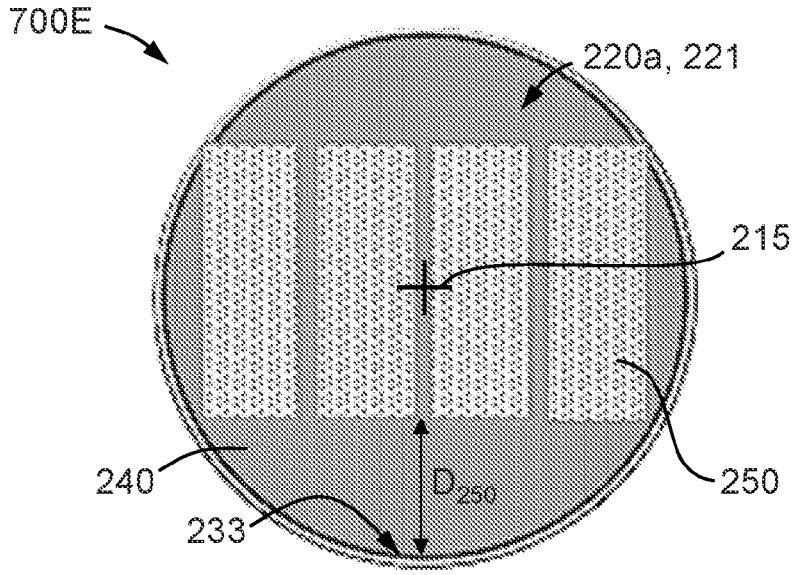
Figure 11F:
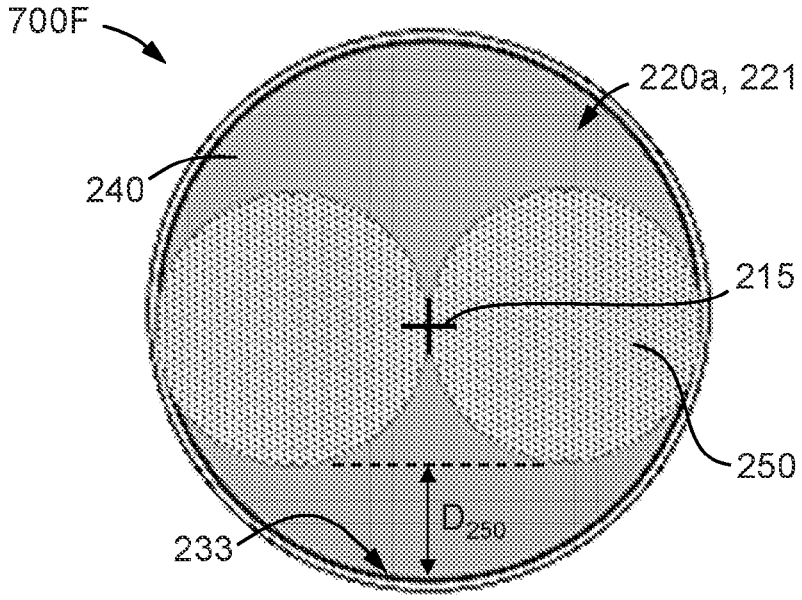
Figure 11G:
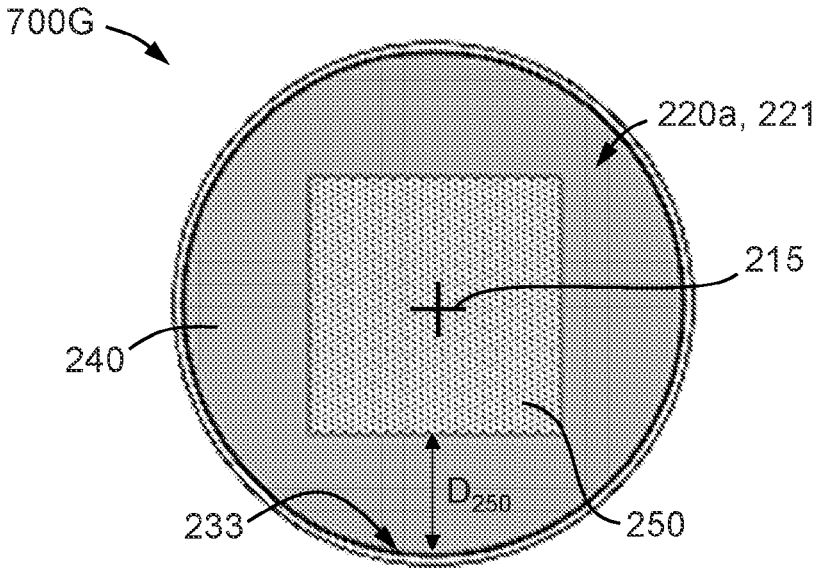
Figure 11H:
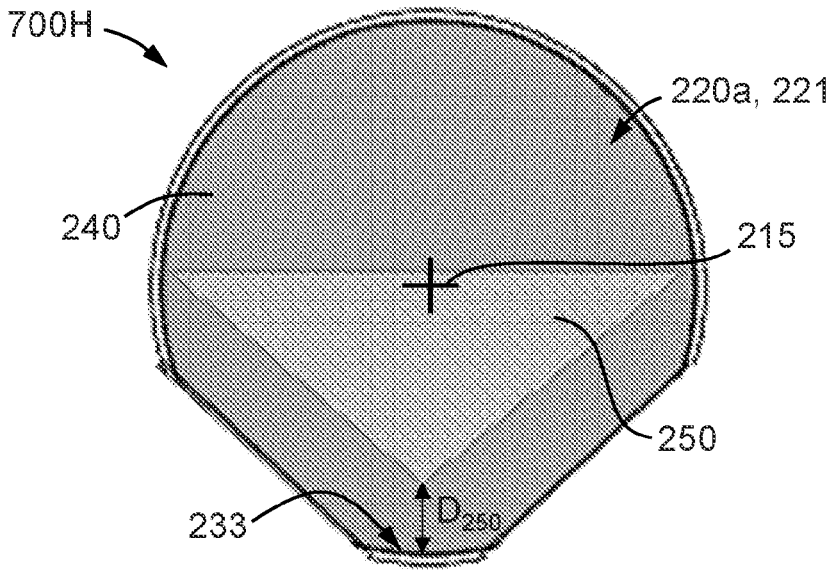
Figure 11I:
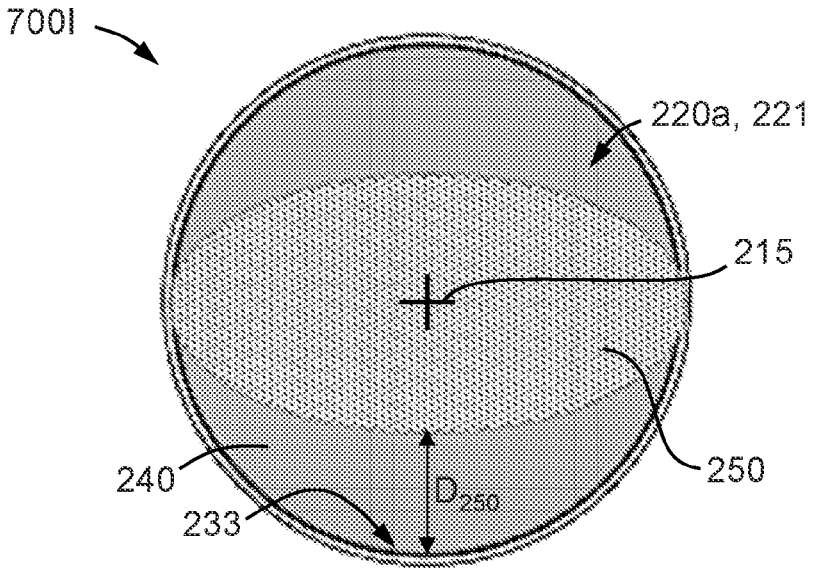
Figure 11J:
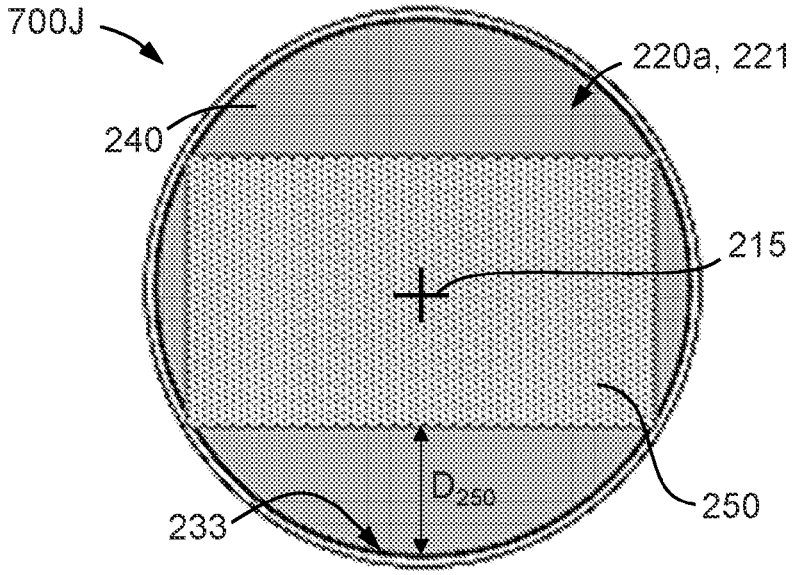
Figure 11K:
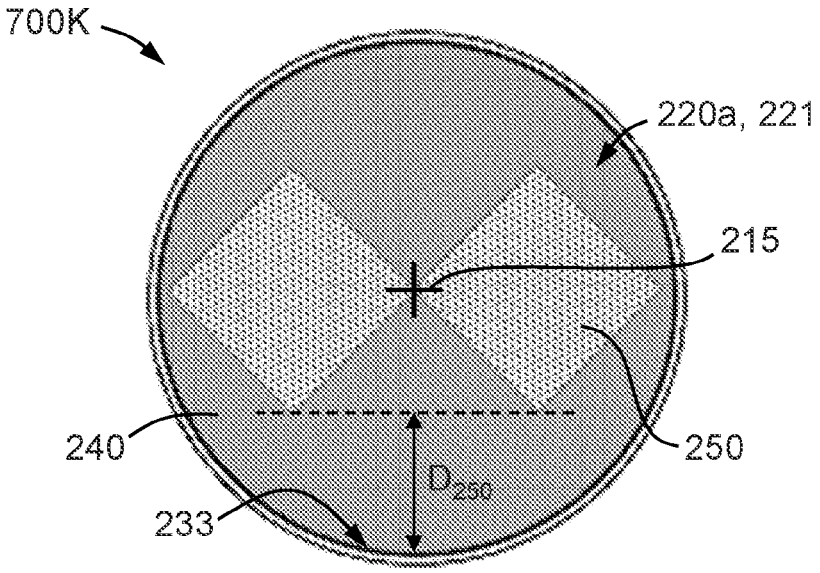
Figure 11L:
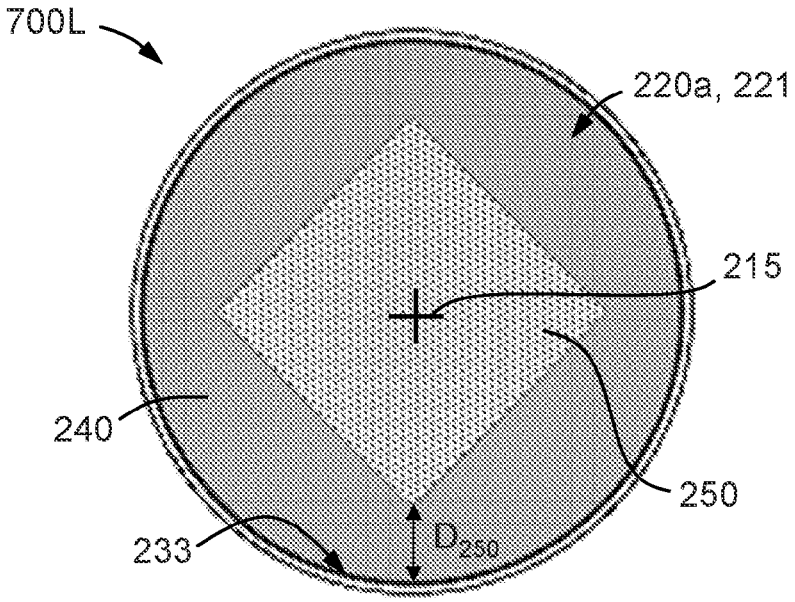
Figure 11M:
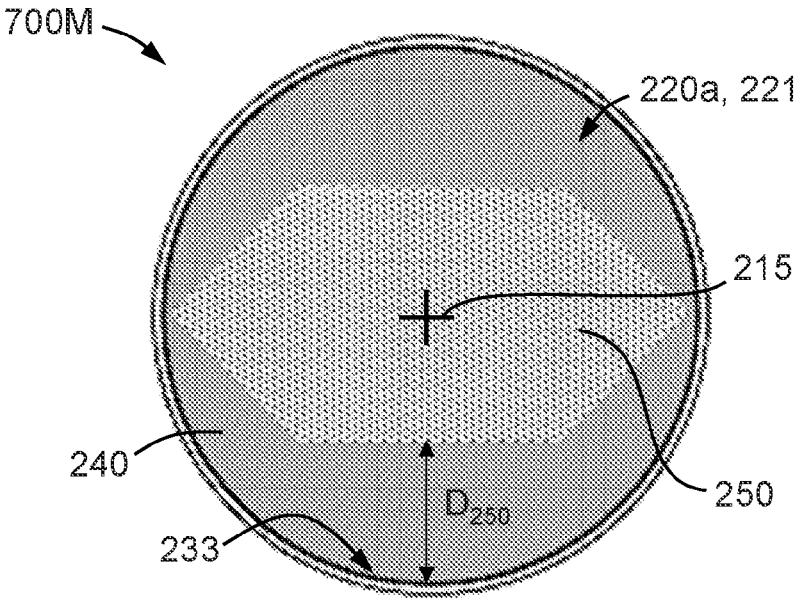
Figure 11N:
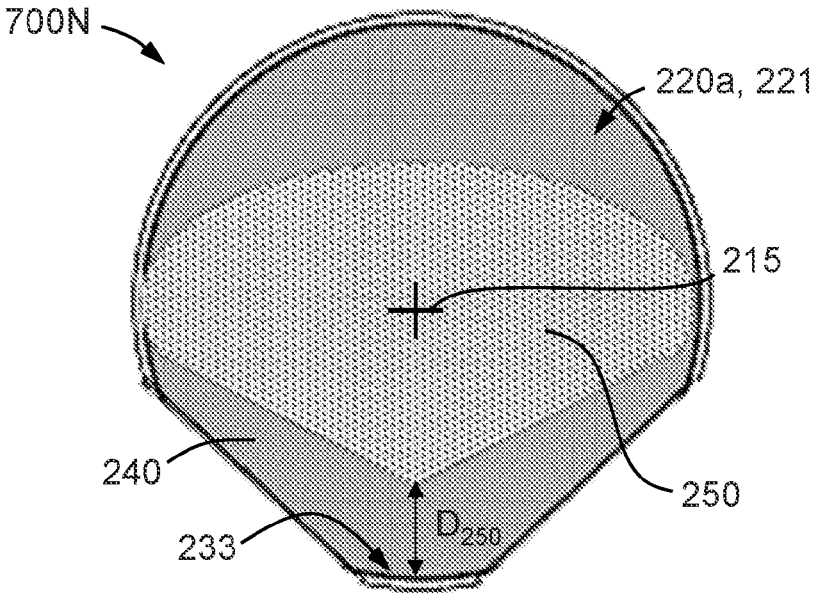

It should be appreciated that the specific arrangement and shape of the first region 240 and the second region 250 on the cutting face 221. Thus, the embodiments disclosed herein are not limited to the circular or partially circular shapes of the second region 250 shown in FIGS. 6A, 6B, 8A, 8B, 9, and 10. For instance, reference is now made to FIGS. 11A-11O which show examples of cutter elements 700A-7000 comprising cutting faces 221 that have various different shapes for the first region 240 and second region 250 according to various embodiments. From the depictions in FIGS. 11A-11O, it should be appreciated that the second region 250 may be formed in a plurality of shapes such as, for instance, elliptically shaped (e.g., FIG. 111), rectangularly shaped (e.g., FIGS. 11E, 11J, 11L), square shaped (e.g., FIG. 11G), or triangularly shaped (e.g., FIGS. 11D, 11H) in some embodiments. In addition, it should be appreciated (e.g., from FIGS. 11A-11L) that the second region 250 may comprise a lobed, or other complex shape (e.g., FIGS. 11B and 11C), or may comprise a star shape (e.g., FIG. 11A) in some embodiments. Further, in some embodiments, the second region 250 may comprise a plurality of regions (e.g., FIG. 11E) or a singular region made up of a plurality of adjacent, contiguous shapes (e.g., FIGS. 11D, 11F).

Figure 11O:
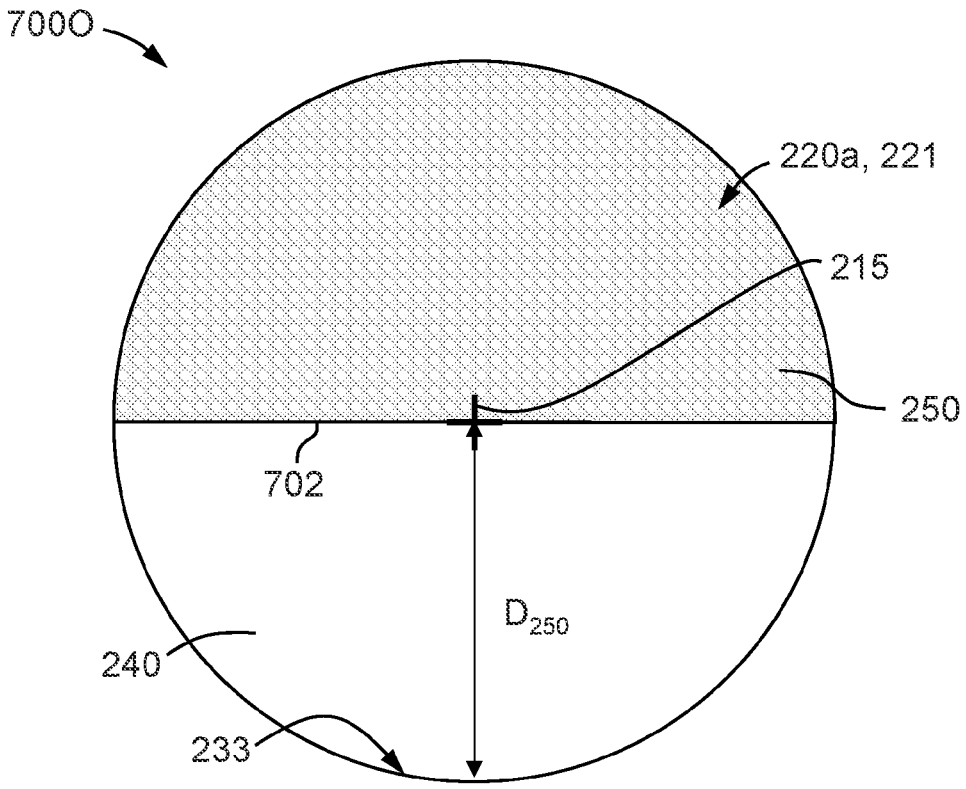

In FIG. 11O, the cutter element 7000 is shown to include a first region 240 and a second region 250 that are formed as semi-circular shaped regions, such that each region 240, 250 makes up approximately 50% of the total surface area of the cutting surface 221, and a linear border 702 extends radially across cutting surface 221, through axis 215. In some embodiments, cutter element 7000 may be modified such that the first region 240 and second region 250 are not each comprise 50% of the total surface area of cutting surface 221 (e.g., the linear border 702 may not extend through axis 215 as shown in FIG. 11O).

Moreover, for the embodiments of the cutter elements 700A-7000, the distance $D_{250}$ and extension height (e.g., H in FIG. 7) of the cutter elements 700A-7000 may be chosen to satisfy the inequality shown in Equation (1) above. Further, in some embodiments the first region 240 and the second region 250 on cutter elements 700A-7000 may conform to one or more of the same sizing parameters that were previously described above for the cutter element 200 (e.g., $0.25 \leq SA_{250}/SA_{240} \leq 0.75$; $SA_{240}+SA_{250}=100\%$ of cutting surface area; etc.) Thus, cutter elements 700A-7000 function in substantially the same manner as cutter element 200, and thus, offers the potential for the same benefits and advantages during drilling operations.

The embodiments disclosed herein include cutter elements for a drill bit that offer the potential to reduce a resistance experienced by the cutter element during drilling. In the manner described herein, embodiments of the cutter elements disclosed herein may include a plurality of regions having different surface roughness that are configured to promote curling or other movement of the formation cuttings away from the cutting face of the cutter element during operations. Thus, through use of the embodiments disclosed herein, a cutting efficiency of the cutter elements on a drill bit may be increased so that the costs of drilling a subterranean borehole may be reduced.

The discussion above is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the discussion herein and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like mean within a range of plus or minus 10%.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A cutter element for a fixed cutter drill bit configured to drill a borehole in a subterranean formation, the cutter element having a central axis and comprising:

a cylindrical substrate; and a cutting layer mounted to the substrate, wherein the cutting layer comprises:

a first end engaged with the substrate, a second end opposite the first end along the central axis, and a radially outer surface extending axially from the first end to the second end;

a cutting surface positioned at the second end of the cutting layer;

a cutting edge positioned between the cutting surface and the radially outer surface of the cutting layer, wherein the cutting edge is configured to engage the subterranean formation during drilling;

a first region on the cutting surface having a first surface roughness; and a second region on the cutting surface having a second surface roughness that is greater than the first surface roughness;

wherein the second region covers the central axis along the cutting surface;

wherein the first region extends from the second region to the cutting edge;

wherein the radially outer surface comprises a cylindrical surface;

wherein the radially outer surface comprises one or more flats; and wherein the second region includes one or more linear edges that are parallel to the one more flats.

2. The cutter element of claim 1, wherein the second surface roughness is about 3 to about 4000 times greater than the first surface roughness.

3. The cutter element of claim 1, wherein the first surface roughness ranges from about 0.0025 micro meters (μm) to about 0.075 μm and the second surface roughness ranges from about 0.25 μm to about 10 μm.

4. The cutter element of claim 1, wherein the second region comprises a circularly shaped region, and the first region comprises an annularly shaped region that extends radially from the second region to the cutting edge.

5. The cutter element of claim 1, wherein the first region has a first surface area, wherein the second region has a second surface area, and wherein a ratio of the second surface area to the first surface area ranges from 0.25 to 0.75.

6. The cutter element of claim 5, wherein a sum of the first surface area and the second surface area constitute an entire surface area of the cutting surface.

7. A fixed cutter drill bit configured to drill a borehole in a subterranean formation, the drill bit comprising:

a bit body having a bit face;

a blade extending from the bit face; and a cutter element mounted to a cutter-supporting surface on the blade, wherein the cutter element has a central axis and comprises:

a substrate; and a cutting layer mounted to the substrate, wherein the cutting layer comprises:

a first end engaged with the substrate, a second end opposite the first end along the central axis, and a radially outer surface extending axially from the first end to the second end of the cutting layer;

a cutting surface positioned at the second end of the cutting layer;

a cutting edge positioned between the cutting surface and the radially outer surface of the cutting layer, wherein the cutting edge is configured to engage the subterranean formation during drilling;

a first region on the cutting surface having a first surface roughness; and a second region on the cutting surface having a second surface roughness that is greater than the first surface roughness;

wherein the second region is spaced radially from the cutting edge at a distance D via the first region;

wherein the cutter element is mounted to the cutter-supporting surface at a backrake angle ε measured between the central axis and the cutter-supporting surface, and wherein the cutter element has an extension height H measured perpendicularly from the cutter-supporting surface to the cutting edge, and wherein the extension height H is less than a projection of the distance D about the backrake angle ε.

8. The fixed cutter drill bit of claim 7, wherein the second surface roughness is about 3 to about 4000 times greater than the first surface roughness.

9. The fixed cutter drill bit of claim 7, wherein the first surface roughness ranges from about 0.0025 micro meters (μm) to about 0.075 μm and the second surface roughness ranges from about 0.25 μm to about 10 μm.

10. The fixed cutter drill bit of claim 7, wherein the second region comprises a circularly shaped region, and the first region comprises an annularly shaped region that extends radially from the second region to the cutting edge.

11. The fixed cutter drill bit of claim 7, wherein the radially outer surface comprises a cylindrical surface;

wherein the radially outer surface comprises one or more flats; and wherein the second region includes one or more linear edges that are parallel to the one more flats.

12. The fixed cutter drill bit of claim 7, wherein the first region comprises a crescent shape.

13. The fixed cutter drill bit of claim 7, wherein the first region has a first surface area, wherein the second region has a second surface area, and wherein a ratio of the second surface area to the first surface area ranges from 0.25 to 0.75.

14. The fixed cutter drill bit of claim 13, wherein a sum of the first surface area and the second surface area constitute an entire surface area of the cutting surface.

15. A cutter element for a fixed cutter drill bit configured to drill a borehole in a subterranean formation, the cutter element having a central axis and comprising:

a substrate; and a cutting layer mounted to the substrate, wherein the cutting layer comprises:

a first end engaged with the substrate, a second end opposite the first end along the central axis, and a radially outer surface extending axially from the first end to the second end of the cutting layer:

a cutting surface positioned at the second end of the cutting layer;

a cutting edge positioned between the cutting surface and the radially outer surface of the cutting layer, wherein the cutting edge is configured to engage the subterranean formation during drilling;

a first region on the cutting surface having a first surface area and a first surface roughness; and a second region on the cutting surface having a second surface area and a second surface roughness:

wherein the first region annularly surrounds the second region;

wherein the second surface roughness is greater than the first surface roughness;

wherein the first surface area and the second surface area constitute an entire surface area of the cutting surface:

wherein the radially outer surface comprises a cylindrical surface;

wherein the radially outer surface comprises one or more flats; and wherein the second region includes one or more linear edges that are parallel to the one more flats.

16. The cutter element of claim 15, wherein the second surface roughness is about 3 to about 4000 times greater than the first surface roughness.

17. The cutter element of claim 15, wherein the first surface roughness ranges from about 0.0025 micro meters (μm) to about 0.075 μm and the second surface roughness ranges from about 0.25 μm to about 10 μm.

18. The cutter element of claim 15, wherein the second region comprises a circularly shaped region, and the first region comprises an annularly shaped region that extends radially from the second region to the cutting edge.

* * * * *